US006902266B2

(12) United States Patent
Kaga et al.

(10) Patent No.: US 6,902,266 B2
(45) Date of Patent: Jun. 7, 2005

(54) FIXING BELT, FIXING ROLLER, PRODUCTION METHOD THEREOF, FIXING APPARATUS AND IMAGE FIXING METHOD UTILIZING THE APPARATUS

(75) Inventors: Makoto Kaga, Hino (JP); Shuji Kida, Hino (JP); Shinichi Suzuki, Hino (JP); Hidenobu Ohya, Hino (JP); Teruyuki Fukuda, Hino (JP); Fujio Miyamoto, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/206,310

(22) Filed: Jul. 26, 2002

(65) Prior Publication Data

US 2003/0095171 A1 May 22, 2003

(30) Foreign Application Priority Data

Aug. 6, 2001 (JP) ..... 2001-237685

(51) Int. Cl.[7] ..... B41J 2/01
(52) U.S. Cl. ..... 347/104; 347/101; 347/102
(58) Field of Search ..... 347/104, 102, 347/101

(56) References Cited

U.S. PATENT DOCUMENTS 4,832,984 A * 5/1989 Hasegawa et al. ..... 427/161
4,842,944 A 6/1989 Kuge et al.
5,489,937 A * 2/1996 Akutsu et al. ..... 347/262
5,489,967 A * 2/1996 Sakagami et al. ..... 399/1
5,652,989 A * 8/1997 Chiba et al. ..... 15/3
5,754,209 A * 5/1998 Thomas et al. ..... 347/103
6,000,793 A * 12/1999 Inamoto ..... 347/101
6,005,594 A * 12/1999 Nanataki et al. ..... 347/156
6,092,891 A * 7/2000 Okubo et al. ..... 347/104
6,299,303 B1 * 10/2001 Wexler ..... 347/105
6,475,713 B1 * 11/2002 Aylward et al. ..... 430/502

FOREIGN PATENT DOCUMENTS

EP 0322127 6/1989
EP 0372479 6/1990
EP 0556953 8/1993
EP 1014220 6/2000
JP 10161448 A * 6/1998 ..... G03G/15/20
JP 103044 11/2000

OTHER PUBLICATIONS

European Search Report EP 02 25 5417.

* cited by examiner

*Primary Examiner*—Lamson Nguyen
*Assistant Examiner*—Leonard Liang
(74) *Attorney, Agent, or Firm*—Muserlian, Lucas and Mercanti

(57) ABSTRACT

A fixing belt or a fixing roller for fixing an ink jet image recorded on an ink jet recording material by heat, the fixing belt comprising a base material having thereon a surface layer contacting the ink jet recording material during fixing, the fixing roller comprising a heating roller and a pressure roller having base materials A and B, respectively, at least one of the heating roller and the pressure roller having a surface layer contacting the ink jet recording material during fixing, wherein the surface layer has a peel strength of not less than 30 g/5 cm or a pencil hardness of HB or more, and the surface layer is produced by a method comprising the steps of: coating a hardenable silicone on the base material by a dip coating; and hardening the coated hardenable silicone by heat.

32 Claims, 1 Drawing Sheet

FIXING BELT, FIXING ROLLER, PRODUCTION METHOD THEREOF, FIXING APPARATUS AND IMAGE FIXING METHOD UTILIZING THE APPARATUS

FIELD OF THE INVENTION

The present invention relates to a fixing belt and a fixing roller, a production method of the same, as well as a thermal fixing apparatus and an image fixing method utilizing the same.

BACKGROUND OF THE INVENTION

Ink jet recording is carried out in such a manner that minute ink droplets are allowed to jet utilizing various working principles, and to allow said ink droplets to adhere onto a recording material so that images as well as text are recorded. Ink jet recording exhibits advantages of relatively high speed, low noise, and ease of multicolor printing.

Further, being based on the recent technical progress, pigment ink, comprising pigments, which exhibit excellent lightfastness, a colorant, has received increasing attention as ink for application requiring images with excellent lightfastness.

Pigments are not soluble in solvents. As a result, pigments are dispersed into solvents and are employed in ink in the form of a dispersed state. Therefore, even when the molecules on the surface of dispersed pigment particles results in photochemical decomposition, any new pigment molecular layer under the decomposed layer is exposed. As a result, a decrease in apparent density is minimized. Therefore, said pigment ink is characterized in that excellent image retention properties are achieved.

However, said pigment ink has caused problems in that after image fixing, it is difficult to create high gloss images due to effects of scattered light, as well as reflected light caused by said pigment particles.

Japanese Patent Publication Open to Public Inspection No. 11-208097 discloses a technique in which recording is carried out onto a recording material having the uppermost layer comprised of a thermoplastic resinous layer, employing pigment ink comprising no dispersing agents, and thereafter, pigment particles are allowed to migrate into said thermoplastic resinous layer. The inventors of the present invention studied said patent and found the following. After said pigment ink was ejected onto said recording material, said pigment particles remained on the surface of said thermoplastic resinous layer, while solvent components of said pigment ink were absorbed by each layer constituting said recording material. Subsequently, by allowing said pigment particles to migrate into said thermoplastic resinous layer, protrusion of printed portion with respect to the non-printed portion, which was specific to said pigment ink, was minimized, whereby consistent gloss enhancing effects were obtained due to enhancement of smoothness.

However, when said pigment particles are not completely buried into said thermoplastic resinous layer, imagewise unevenness is created in the printed portion as well as in the non-printed portion, whereby a gloss difference between them tends to occur. On the other hand, when said pigment particles are completely buried, any gloss difference between the printed portion and the non-printed portion is eliminated. However, other problems occur in which desired glossiness characteristics are not obtained.

Further, Japanese Patent Publication Open to Public Inspection No. 2000-103044 discloses a heating roller and a pressure roller, which is provided so as to face said heating roller, as a drying means to dry ink ejected onto a recording material. By employing said technique, protruding ink is assuredly smoothened and ink results in more desired gloss than that created by conventional image forming apparatus. However, problems have occurred in which the resultant gloss does not reach the desired level and a peeling ability of said heating roller from pigment ink is insufficient.

Still further, Japanese Patent Publication Open to Public Inspection No. 2000-1512 discloses an image output apparatus which is provided with an image forming section which forms images on a printing material, employing ink, and a pressure section which applies pressure to said printing material, on which images are formed, employing said image forming section, in order to output high gloss images without using special recording sheets and ink.

Said patent also discloses a fixing apparatus utilizing silicone rubber, coated with fluorine and is arranged in said image output apparatus. However, problems have occurred in which the resultant images do not exhibit sufficient gloss and peeling ability of the roller from the pigment ink was insufficient.

In image processing apparatuses such as electrophotographic copiers and electrophotographic printers, which utilize electrophotographic processes, it is necessary that toner images, which have been transferred to transferring materials such as copy paper sheets, are fixed. Widely employed as said toner image fixing method is one in which a paper sheet is allowed to pass between a rotating heating roller and a pressure roller in contact with each other so that the toner image on said copy paper sheet is thermally fused.

However, said method has caused the following problems. Due to the relatively short contact length of said copy paper sheet with said fixing roller depending on its radius of curvature, said copy paper sheet is separated from said fixing roller after a relatively short contact time with said fixing roller. Specifically, full color toner of a relatively low meting point tends to result in offsetting and the surface of said toner is roughened. As a result, the resultant toner images do not result in a mirror surface, whereby it is difficult to prepare images of the desired gloss.

Further, heretofore, in order to minimize offsetting, silicone oil has been applied onto the surface of the fixing roller. However, problems have occurred in which, since it becomes necessary to provide a device to apply said silicone oil, the resultant apparatus becomes more complex. In addition, when an original document is copied onto OHP film, it has been noted that said film is stained with said silicone oil.

Still further, Japanese Patent Publication Open to Public Inspection No. 5-265337 discloses that in a fixing belt comprising a base material having on its surface a surface layer, said belt is characterized in that said surface layer is comprised of a silicone resin.

Said fixing belt is effective to enhance the glossiness of full color toner images, while it does not effectively enhance the glossiness of ink jet recording images to the desired level. Further, problems have occurred in which the surface layer on said fixing belt tends to result in layer peeling.

SUMMARY OF THE INVENTION

An object of the present invention is to provide a fixing belt and a fixing roller which result in excellent image gloss after fixing, and result in neither layer peeling of the fixing member during thermal fixing nor offsetting, a production method of the same, a thermal fixing apparatus, and an image forming method.

The aforementioned object of the present invention was achieved employing the embodiments described below.

Item.1

A fixing belt for fixing an ink jet image recorded on an ink jet recording material by heat, the fixing belt comprising a base material having thereon a surface layer contacting the ink jet recording material during fixing, wherein the surface layer has a peel strength of not less than 30 g/5 cm, and the surface layer is produced by a method comprising the steps of:

coating a hardenable silicone on the base material by a dip coating; and hardening the coated hardenable silicone by heat.

Item.2

A fixing belt for fixing an ink jet image recorded on an ink jet recording material by heat, the fixing belt comprising a base material having thereon a surface layer contacting the ink jet recording material during fixing, wherein the surface layer has a pencil hardness of HB or more, and the surface layer is produced by a method comprising the steps of:

coating a hardenable silicone on the base material by a dip coating; and hardening the coated hardenable silicone by heat.

Item.3

A fixing roller comprising a heating roller and a pressure roller for fixing an ink jet image recorded on a ink jet recording material by letting the recording material through between the heating roller and the pressure roller, the heating roller having a base material A, the pressure roller having a base material B, at least one of the heating roller and the pressure roller has a surface layer contacting the ink jet recording material during fixing, wherein the surface layer has a peel strength of not less than 30 g/5 cm, and the surface layer is produced by a method comprising the steps of:

coating a hardenable silicone on the base material by a dip coating or a bead coating utilizing a circular slide hopper; and hardening the coated hardenable silicone by heat.

Item.4

A fixing roller comprising a heating roller and a pressure roller for fixing an ink jet image recorded on a ink jet recording material by letting the recording material through between the heating roller and the pressure roller, the heating roller having a base material A, the pressure roller having a base material B, at least one of the heating roller and the pressure roller has a surface layer contacting the ink jet recording material during fixing, wherein the surface layer has a pencil hardness of HB or more, and the surface layer is produced by a method comprising the steps of:

coating a hardenable silicone on the base material by a dip coating or a bead coating utilizing a circular slide hopper; and hardening the coated hardenable silicone by heat.

Item. 5

An image fixing apparatus comprising a heating means, a pressure means and the fixing belt described in Item.1 or Item.2, the heating and fixing apparatus fixing an ink jet image recorded on an ink jet recording material by letting the ink jet recording material and the fixing belt in a facing state through between the heating section and the pressure section.

Item.6

An image fixing apparatus comprising the fixing roller described in Item.3 or Item.4.

Item.7

A producing method of a fixing belt for fixing an ink jet image recorded on an ink jet recording material, the method comprising the steps of:

coating a hardenable silicone onto a base material by a dip coating; and making a surface layer by fixing the coated hardenable silicone by heat, wherein the surface layer has a peel strength of not less than 30 g/5 cm.

Item.8

A producing method of a fixing belt for fixing an ink jet image recorded on an ink jet recording material, the method comprising the steps of:

coating a hardenable silicone onto a base material by a dip coating; and making a surface layer by fixing the coated hardenable silicone by heat, wherein the surface layer has a pencil hardness of HB or more.

Item.9

A producing method of fixing roller comprising a heating roller and a pressure roller for fixing an ink jet image recorded on a ink jet recording material by letting the recording material through between the heating roller and the pressure roller, the heating roller having a base material A, the pressure roller having a base material B, the method comprising the steps of:

coating a hardenable silicone onto at least one of the base material A and the base material B by a dip coating or a bead coating utilizing a circular slide hopper; and making a surface layer by fixing the coated hardenable silicone by heat, wherein the surface layer has a peel strength of not less than 30 g/5 cm.

Item.10

A producing method of fixing roller comprising a heating roller and a pressure roller for fixing an ink jet image recorded on a ink jet recording material by letting the recording material through between the heating roller and the pressure roller, the heating roller having a base material A, the pressure roller having a base material B, the method comprising the steps of:

coating a hardenable silicone onto at least one of the base material A and the base material B by a dip coating or a bead coating utilizing a circular slide hopper; and making a surface layer by fixing the coated hardenable silicone by heat, wherein the surface layer has a pencil hardness of HB or more.

Item.11

An image fixing method for fixing an ink jet image recorded on an ink jet recording material with utilizing a heating means, a pressure means and the fixing belt described in Item.1 or Item.2, the method comprising:

letting the ink jet recording material and the fixing belt in a facing state through between the heating means and the pressure means.

PREFERRED EMBODIMENTS OF THE INVENTION one embodiment of the present invention will now be described with reference to drawings. The fixing belt is described with reference to FIG. 1, while the fixing roller is described with reference to FIG. 2.

Figure 1:
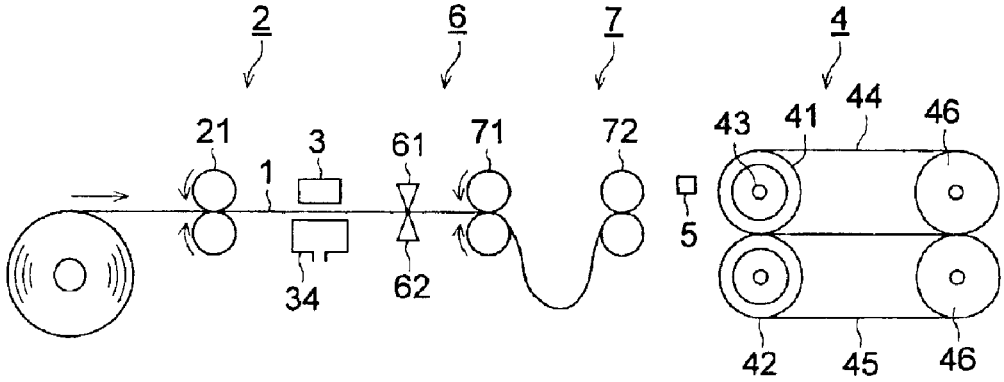
FIG. 1 is a schematic view showing one example of the structure of an ink jet recording apparatus employed in the present invention.

FIG. 1 is a schematic view showing one example of the structure of an ink jet recording apparatus employed in the present invention. In FIG. 1, recording material 1 fed from paired transport rollers 21 is subjected to ink jet recording, employing printing head 3 and is then cut to a desired size, employing cutter 61. The resultant cut material is conveyed to first paired rollers and then to second paired rollers in a suspended state. Subsequently, said material is conveyed to thermal fixing means 4 and passed between heating roller 41, comprising heating body 43 in its interior, and pressure roller 42 together with fixing belt 44, whereby a thermal fixing treatment is carried out.

The surface of said fixing belt, which comes into contact with said recording material 1, is provided with a surface layer, though it is not shown, and said surface layer comprises the silicone resin according to the present invention.

Figure 2:
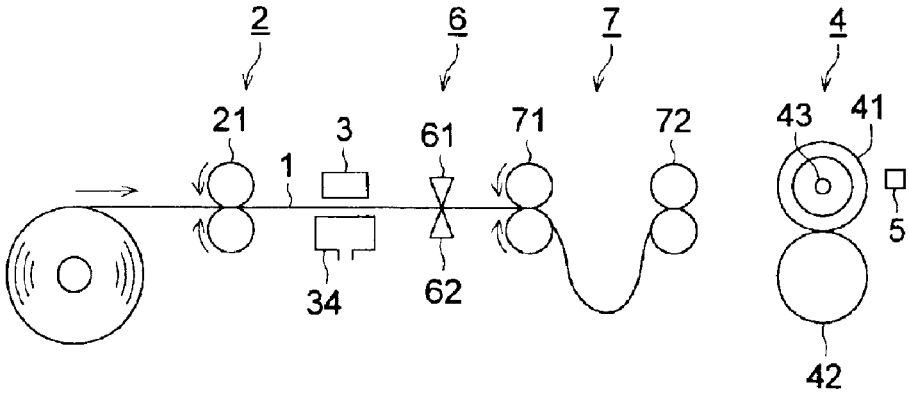
FIG. 2 is a schematic view showing another example of the structure of an ink jet recording apparatus employed in the present invention.

FIG. 2 is a schematic view showing another example of the structure of the ink jet recording apparatus employed in the present invention. In FIG. 2, recording material 1, fed from paired transport rollers 21, is subjected to ink jet recording employing as printing head 3 and is cut to a desired size, employing cutter 61. The resultant cut material is conveyed to first paired rollers and then to second paired rollers in a suspended state. Subsequently, said material is conveyed to thermal fixing means 4 and passed between heating roller 41, comprising heating body 43 in its interior, and pressure roller 42, whereby a thermal fixing treatment is carried out.

The surface of said heating roller is provided with a surface layer, though it is not shown, and the silicone resin according to the present invention is incorporated into said surface layer.

In order to obtain the effects described in the present invention, namely, to result in excellent image gloss after image formation, no peeling of the surface layer provided on the fixing belt nor on the fixing roller during fixing, and to minimize the formation of offsetting during fixing, each of embodiments, described in (1) through (4) shown below is preferably employed.

(1) Each surface of said fixing belt and said fixing roller, which comes into contact with said recording material, is provided with a surface layer, comprising a silicone resin, and the peel strength of said surface layer is preferably adjusted to be not less than 30 g/5 cm, is more preferably adjusted to the range of 30 to 1,000 g/5 cm, and is most preferably adjusted to the range of 50 to 600 g/5 cm.

Herein, the peel strength of said surface layer is determined employing the method described below.

<<Method for Determining Surface Peel Strength of Surface Layer>>

In the case of the fixing belt shown in FIG. 1, adhesive tape (Nitto Polyester Tape No. 31B, manufactured by Nitto Denko Corp.) is adhered onto the surface of the surface layer of the fixing belt, while in the case of the fixing roller shown in FIG. 2, the same adhesive tape is adhered onto the surface layer of the heating roller or the pressure roller. While setting the pressure of said pressure roller at 2 kg, a pressure contact operation corresponding to one rotation of said pressure roller is carried out. Subsequently, at room temperature, the resultant fixing belt or the fixing roller is set aside for 20 hours. Thereafter, the peel strength is determined employing a commercially available peeling tester at a rate of 0.3 m/minute while pulling said adhesive tape at an angle of 180 degrees.

Incidentally, when said surface layer is provided on both of the heating roller of the fixing roller and the pressure roller, the peel strength of the surface layer on the side, which comes into contact the recording material, is determined.

(2) Each surface of said fixing belt and said fixing roller, which comes into contact with said recording material, comprises a surface layer comprising a silicone resin. The pencil hardness of said surface layer is preferably adjusted to be at least HB, is more preferably adjusted to the range of H to 5H, and is most preferably adjusted to the range of 2H to 5H.

<<Method for Determining Pencil Hardness of Surface Layer>>

Herein, the pencil hardness of said surface layer is determined in accordance with JIS K 5401. Upon determination, employed as a pencil is "uni" (manufactured by Mitsubishi Pencil Co., Ltd.), while employed as a measurement apparatus is a Pencil Scratch Tester No. 850, manufactured by Coating Tester Industries, Co., Ltd.

Under application of a specified load, a sharpened pencil point is pulled across said layer and the hardness of said layer is evaluated by observing the formation of scratches on the coating. In the present invention, a pencil loaded at 1 kg is pulled 5 times at an angle of 45 degrees. When at least 2 scratches are observed, the same test is carried out employing a pencil which is one grade softer. When the number of scratches is less than 2, the symbol of hardness of said pencil is defined as the pencil hardness. For example, when at least 2 scratches are observed employing a 5H hardness pencil and fewer than 2 scratches are observed employing a 4H hardness pencil, the pencil hardness value of the tested surface layer is designated as 4H.

(3) A fixing belt or a fixing roller having a structure wherein a primer layer is provided on a base material and a surface layer is provided on said primer layer.

(4) A fixing belt having a structure in which hardenable silicone is applied onto a base material employing a dip coating, and subsequently, a surface layer comprising silicone resin is formed upon thermally hardening said hardenable silicone.

(5) A fixing belt having a structure in which employed as base material is a seamless nickel belt and a surface layer, comprising a silicone resin, is formed on said seamless nickel belt.

The silicone resin according to the present invention will now be described.

Preferred as silicone resins according to the present invention are those which exhibit a peel strength of not less than 30 g/5 cm and are prepared employing hardenable silicones such as addition hardenable silicone, as well as condensation hardenable silicone, described below. Of these, silicone resins which are prepared employing condensation hardenable silicone, are more preferred. Further, from the viewpoint of decreasing variation of glossiness during image formation, as well as minimizing peeling of the surface layer during fixing, it is preferable that the silicone resins of the present invention satisfy the conditions in that the pencil hardness of the surface layer is at least HB. Further, the pencil hardness value is preferably in the range of H to 5H, and is still more preferably in the range of 2H to 5H.

Said addition hardenable silicone is, for example, prepared by allowing methylhydrogenpolysiloxane to react with straight chain methylvinylpolysiloxane having a vinyl group at both terminals or at both terminals, as well as in the chain, in the presence of platinum based catalysts.

Listed as specific examples of addition hardenable silicones are KS-887, KS-779H, KS-778, KS-835, X-62-2456, X-62-2494, X-62-2461, KS-3650, KS-3655, KS-3600, KS-847, KS-770, KS-770L, KS-776A, KS-856, KS-775, KS-830, KS-830E, KS-839, X-62-2404, X-62-2405, KS-3702, X-62-2232, KS-3503, KS-3502, KS-3703, and KS-5508, all manufactured by Shin-Etsu Silicone Co.

Listed as specific examples of condensation hardenable silicones, which are preferably employed, are KS-881, KS-882, KS-883, X-62-9490, and X-62-9028, all of which are also manufactured by Shin-Etsu Silicone Co. Of these, preferably employed are double release silicones for release paper such as KS-881, KS-882, KS-883, X-62-9490, and X-62-9028.

The surface contact angle of the surface layer, according to the present invention, is preferable from 100 to 120 degrees, and is more preferably from 105 to 115 degrees. The surface contact angle, as described herein, refers to the contact angle of the surface of said surface layer with respect to pure water. Said surface contact angle is determined employing, for example, an Automatic Contact Angle Meter AC-VZ (manufactured by Kyowa Kaimen Kagaku Co.) while utilizing a liquid drop method (approximately 15 $\mu$l of pure water is carefully dripped onto the surface t be measured and 0.5 second after contact, the contact angle is determined).

Surface roughness (which is defined below) of the surface layer, according to the present invention, is preferably at most 0.2 $\mu$m, and is more preferably at most 0.1 $\mu$m.

Thickness of the surface layer, according to the present invention, is preferably from 1 to 50 $\mu$m, and is more preferably from 10 to 30 $\mu$m.

The primer layer according to the present invention will now be described.

It is preferable that each of the fixing belt and the fixing roller comprises a base material thereon a primer layer.

Said primer layer is prepared as follows: Listed as preferred components are silane coupling agents (for example, X-92-185, manufactured by Shin-Etsu Kagaku Kogyo Co., and primer compositions for a hard coating silicone), polyvinyl alcohol resins (for example, PVA-124, 224, and 424, all manufactured by Kuraray Kogyo Co., Ltd.), butyral resins (for example, 3000K, manufactured by Denki Kagaku Kogyo Co.), metal alkoxides such as titanium alkoxide and zirconium alkoxide, ethylene-vinyl acetate copolymers, olefin based resins such as vinylidene chloride or butadiene based resins, urethane based resins, polyester based resins, acryl based resins, epoxy based resins, and polyethyleneimine based resins. Further, these resins may be thermally hardened employing hardening agents such as isocyanate based compounds, amine based compound, and acid anhydrides, or may be hardened employing ultraviolet rays as well as an electron beam.

Further, if desired, it is possible to employ compounds described in Chapters 33 through 36 of "Shin Laminate Kakoh Binran (New Lamination Handbook)", edited by Kakoh Gijutsu Kyokai, in the present invention.

It is possible to provide the primer layer according to the present invention, employing a coating method in which layer forming components are directly or after being dissolved in suitable solvents are coated and subsequently dried, or a melt coating method in which layer forming components are melted and coated.

Listed as solvents employed in said coating methods are, for example, water, alcohols, cellosolves, aromatics, ketones, ester based solvents, ethers, and chlorine based solvents. It is possible to carry out said coating employing a dip coating method, a gravure roller coating method, an extrusion coating method, a wire bar coating method or a roller coating method, all of which are known in the prior art.

Incidentally, the thickness of said primer layer is preferably adjusted to the range of 0.1 to 50 $\mu$m.

Base materials for the belt member employed in the fixing belt according to the present invention, as well as each base material employed in the heating roller and the pressure roller of the fixing rollers, according to the present invention, will now be described.

From the viewpoint of obtaining desired effects described in the present invention, preferred as the base material employed in said belt member is seamless electric forming nickel, while preferred as the base material of said heating roller and pressure roller is nickel. The thickness of said base material is preferably from 10 to 100 $\mu$m.

Further, employed as materials of said base material, other than nickel, may be aluminum, iron, and polyethylene.

The surface roughness of the base material of the fixing belt, as well as of the base material of the heating roller and the pressure roller according to the present invention is preferably less than or equal to 0.1 $\mu$m, and is more preferably less than or equal to 0.08 $\mu$m. Further their Young's modulus is preferably more than or equal to 50 kN/mm$^2$, and is more preferably from 50 to 300 kN/mm$^2$.

Herein, the measurement method of the surface roughness of said surface layer, as well as the surface roughness of said fixing belt and fixing roller, will now be described.

In the present invention, surface roughness Ra was determined based on the following method.

Employed as atomic force microscopy (AFM), was SPI3800 N Probe Station and SPA Multifunctional Type Unit, manufactured by Seiko Instruments Co. A test sample was cut to an approximate 1 cm square. The cut sample was placed on a horizontal sample stand and a cantilever was allowed to approach said sample surface. When said cantilever approached the region at which the atomic force takes effect, scanning was carried out in the XYZ directions. During said operation, unevenness of said sample was detected in the form of piezoelectric displacement in the Z direction. Employed as a piezoelectric scanner was one capable of scanning of XY 20 $\mu$m and Z 2 $\mu$m. Employed as said cantilever was silicon cantilever S1-DF20, manufactured by Seiko Instruments Co., having a resonance frequency of 120 to 150 kHz, and a spring constant of 12 to 20 N/m. Measurement was carried out under a DFM Mode (Dynamic Force Mode). The measurement region of a 2 $\mu$m square was measured employing 1 (or 2) visual field(s) and a scanning frequency of 1 Hz. Further, obtained data were subjected to least square approximation, and slight inclination of said sample was corrected and a standard plane was obtained.

Analysis of said surface roughness was carried out upon retrieving Surface Roughness Analysis from analysis software SPIwin (ver.2 05D2, manufactured by Seiko Instruments Co.). Then, an average roughness was determined based on the obtained three-dimensional data.

The measured surface is expressed by Z=F(X,Y). The range of (X,Y) is from (0,0) to ($X_{max}$, $Y_{max}$). When the surface which is subjected to roughness analysis is designated as the specified surface*, surface area $S_0$ is obtained by the following formula.

$$S_0=X_{max}\cdot Y_{max}$$

When the average of Z data within the specified surface is expressed by $z_0$, $z_0$ is expressed by the following formula, while taking a horizontal surface, satisfying $z=z_0$, as a standard surface.

$$Z_0 = \frac{1}{S_0} \int_0^{Y_{max}} \int_0^{X_{max}} F(X, Y) dX dY$$

In JIS B 601, center-line mean roughness (Ra) is expressed as follows. A portion of length L is extracted from the roughness curve in the center-line direction. When the center-line direction of said extracted portion is designated as the X axis, the longitudinal power direction is designated as the Y axis, and when the roughness curve is expressed by Y=F(X), Ra is defined as a value given by the following formula.

$$Ra = \frac{1}{L} \int_0^L |F(X)| dX$$

In the present invention, said center-line mean roughness Ra is three-dimensionally expanded so as to be applicable to the measured surface, and the value obtained from the resultant formula is defined as the surface roughness (hereinafter occasionally referred to as average roughness Ra) of the present invention. Further, said roughness is expressed as a value obtained by averaging the absolute values of deviation from the standard surface to the specified surface. The employed value is which is obtained using the following formula.

$$Ra = \frac{1}{S_0} \int_0^{Y_{max}} \int_0^{X_{max}} |F(X, Y) - Z_0| dX dY$$

A production method of the fixing belt as well as the fixing roller according to the present invention will now be described.

In said production method of the fixing belt as well as the fixing roller according to the present invention, it is preferable that its surface layer is formed through a thermal hardening process after dip-coating hardenable silicone, such as addition hardenable silicone or condensation hardenable silicone, onto the side of the fixing belt surface, which comes into contact with a recording material, or the surface of at least one of the heating roller or the pressure roller constituting the fixing rollers.

The surface layer according to the present invention may be coated in such a manner that after coating a sublayer such as a primer layer employing a dip coating system, a bar coating system, a blade coating system, an air-knife coating system, a slide coating apparatus, or a curtain coating system, said surface layer is applied onto the resultant coating. However, it is preferable that the surface layer according to the present invention applies said hardening hardenable silicone onto a base material or a primer layer, employing a dip coating system.

Herein, when said dip coating mentioned above is carried out, it is preferable to adjust the viscosity of coating compositions to the range of 0.01 to 0.50 Pa/s.

Recording materials (also referred to as recording mediums) used in the present invention will now be described.

Said recording materials are not particularly limited as long as they are receptive to ink and can form images. However, from the viewpoint of strength, preferred are those comprising a support having thereon an ink receptive layer.

Employed as said supports may be those including paper supports such as plain paper, art paper, coated paper and cast-coated paper, plastic supports, paper supports coated with polyolefin on both sides, and composite supports prepared by laminating those above, which have been employed as common ink jet recording materials.

For the purpose of increasing the adhesion force between the support and the ink absorptive layer, it is preferable that prior to coating said ink absorptive layer, said support is subjected to a corona discharge treatment or a subbing treatment. Further, the recording paper sheets of the present invention need not necessarily be white, but may be colored. Further, it is particularly preferred to employ paper supports prepared by laminating both sides of a base paper support with polyethylene so that recorded images approach conventional photographic quality and high quality images are obtained at low cost.

Such paper supports, which are laminated with polyethylene, will now be described.

Base paper employed for said paper support is produced employing wood pulp as a main raw material, and if desired, employing synthetic pulp such as polypropylene, or synthetic fiber such as nylon or polyester. As wood pulp, for example, any of LBKP, LBSP, NBKP, NBSP, LDP, NDP, LUKP, and NUKP may be employed. However, LBKP, NBSP, LBSP, NDP, and LDP having shorter fibers are preferably employed in a larger proportion. However, the content proportion of LBSP or LDP is preferably from 10 to 70 percent by weight.

As the above-mentioned pulp, chemical pulp (sulfate salt pulp and sulfite pulp) containing minimum impurities is preferably employed, and pulp, which has been subjected to bleaching treatment to increase whiteness, is also beneficial.

Suitably incorporated in said base paper may be, for example, sizing agents such as higher fatty acids and alkylketene dimers, white pigments such as calcium carbonate, talc, titanium dioxide, paper strength enhancing agents such as starch, polyacrylamide, and polyvinyl alcohol, optical brightening agents, moisture retaining agents such as polyethylene glycols, dispersing agents, and softeners such as quaternary ammonium salts.

The degree of water freeness of pulp employed for papermaking is preferably between 200 and 500 ml according to CSF specifications. Further, the sum of weight percent of 24-mesh residue and weight percent of 42-mesh calculated portion regarding the fiber length after beating, specified in JIS-P-8207, is preferably between 30 and 70 percent. Incidentally, the weight percent of 4-mesh residue is preferably less than or equal to 20 percent by weight.

The basis weight of said base paper is preferably from 30 to 250 g/m$^2$, and is more preferably from 50 to 200 g/m$^2$. The thickness of said base paper is preferably from 40 to 250 $\mu$m.

Said base paper may be provided with high smoothness through a calendering treatment during a paper making stage or after paper making. Density of said base paper is commonly from 0.7 to 1.2 g/cm$^3$ (based on JIS P 8118). Stiffness of said base paper is preferably from 20 to 200 g under conditions specified in JIS P 8143.

The surface of said base paper may be coated with surface sizing agents. Employed as said surface sizing agents may be sizing agents such as higher fatty acids and alkylketene dimers which may be incorporated in said base paper.

The pH of said base paper is preferably from 5 to 9, when determined employing the hot water extraction method specified in JIS P 8113.

Polyethylene employed for coating both sides of said base paper is comprised mainly of low density polyethylene (LDPE) and/or high density polyethylene (HDPE). In addition, LLDPE and polypropylene may be partially employed.

As widely employed in photographic paper, rutile or anatase type titanium oxide is preferably incorporated in polyethylene which is employed to prepare the polyethylene layer on the ink absorptive layer side so that the resultant opacity as well as whiteness is enhanced. The content proportion of said titanium oxide is commonly from 3 to 20 percent by weight, and is preferably from 4 to 13 percent by weight.

Polyethylene coated paper may be employed as glossy paper. Further, when polyethylene is applied onto the surface of said base paper through melt-extrusion, a matte surface or a silk surface, which is commonly available in photographic paper, may be prepared employing a so-called embossing process. In the present invention, such embossed polyethylene coated paper may also be employed.

The used amount of polyethylene on both sides of said base paper is determined so as to minimize curl at low humidity as well as at high humidity, after providing a porous layer and a backing layer. The thickness of the polyethylene layer on the porous layer side is commonly in the range of 20 to 40 $\mu$m, while the thickness on the backing layer side is commonly in the range of 10 to 30 $\mu$m.

Further, it is preferable that said polyethylene coated paper supports have the characteristics described below.

1. Tensile strength: tensile strength in the longitudinal direction is preferably from 2 to 30 kg, and the same in the lateral direction is preferably from 1 to 20 kg in terms of the tensile strength specified in JIS P 8113.
2. Tear strength: tear strength in the longitudinal direction is preferably from 10 to 200 g, and the same in the lateral direction is preferably from 20 to 200 g when determined employing the method specified in JIS P 8116.
3. Compressive elasticity modulus $\geqq$98.1 MPa
4. Surface Beck smoothness: glossy surface preferably results in at least 20 seconds under conditions specified in JIS P 8119. However, a so-called embossed surface may be less or equal to said value.
5. Surface roughness: the average surface roughness, specified in JIS B 0601, preferably exhibits a maximum height, per the standard length of 1.5 mm, of at most 10 $\mu$m.
6. Opacity: opacity is preferably at least 80 percent and is more preferably from 85 to 98 percent, when determined employing the method specified in JIS P 8183.
7. Whiteness: L*, a*, and b*, specified in JIS Z 8729 are preferably from 80 to 95, from −3 to +5, and from −6 to +2, respectively.
8. Surface glossiness: 60-degree specular glossiness specified in JIS Z 8741 is preferably from 10 to 95 percent.
9. Clark stiffness: supports having a Clark stiffness of recording paper sheets in the transport direction of 50 to 300 $cm^2/100$ is preferred.
10. Moisture content in core paper: moisture content of core paper is commonly from 2 to 100 percent by weight with respect to the core paper, and is preferably from 2 to 6 percent by weight.

The ink absorptive layer of recording materials is mainly divided into a swelling type and a porous type.

In said swelling type, hydrophilic binders, such as gelatin, polyvinyl alcohol, polyvinylpyrrolidone, and polyethylene oxide, are coated individually or in combination so as to be usable as an ink absorptive layer.

In said porous type, minute particles and hydrophilic binders are blended and coated. Those which result in gloss are preferred. Preferred as minute particles are alumina and silica. Particularly preferred are those employing silica of a particle diameter of less than or equal to 0.1 $\mu$m. Preferred as hydrophilic binders are binders such as gelatin, polyvinyl alcohol, polyvinylpyrrolidone, and polyethylene oxide which may be employed individually or in combination.

In order to achieve continuous or high speed printing, recording materials which result in a high ink absorbing rate are more preferred. From said view point, porous type recording materials are more preferable employed.

The porous type ink absorptive layer of the recording material, employed in the present invention, will now be described.

A porous layer is formed mainly utilizing the soft coalescence of hydrophilic binders and fine inorganic particles. Heretofore, various methods have been known which form pores in a layer. For example, such methods include a method in which a uniform coating composition, comprising at least two types of polymers, is applied onto a support and during the drying process, these polymers are subjected to phase separation from one another so as to form pores, a method in which a coating composition, comprising fine solid particles and hydrophilic or hydrophobic binders, is applied onto a support, and after drying, pores are formed by immersing the resultant ink jet recording sheet in a composition containing water, or suitable organic solvents, so as to form pores by dissolving fine solid particles, a method in which after coating a coating composition, comprising compounds which generate gas during layer formation, pores are formed by allowing said compounds to generate gas during a drying process, a method in which a coating composition, comprising fine porous solid particles and hydrophilic binders, is applied onto a support, and pores are formed in said fine porous solid particles or between said fine particles, and a method in which a coating composition, comprising fine solid particles or fine oil droplets having approximately the same or a larger volume than hydrophilic binders and hydrophilic binders is applied onto a support and pores are formed between said fine solid particles. In the present invention, it is particularly preferred that pores are formed by incorporating various types of fine inorganic solid particles in the porous layer, having an average diameter of less than or equal to 100 $\mu$m.

Listed as fine inorganic particles employed to achieve said purposes may be white inorganic pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

The average diameter of fine inorganic particles is obtained as follows. Particle themselves or particles which appear in the cross-section or on the surface of a porous layer are observed employing an electron microscope, and the diameter of each of 1,000 randomly selected particles is determined. Subsequently, an arithmetic average (or number average) is obtained based on the measured data. Herein, the diameter of each particle is expressed as a diameter of a circle having the same projected area as said particle.

Preferably employed as fine solid particles are those selected from alumina or alumina hydrate, and silica is more preferred.

Preferably employed as said silica are silica synthesized employing a conventional wet method, colloidal silica, and silica synthesized employing a gas phase method. In the present invention, listed as the most preferably employed fine particle silica is colloidal silica or fine particle silica synthesized employing a gas phase method. Of these, fine particle silica, synthesized employing a gas phase method, is more preferred, since it enables obtaining a high void ratio and in addition, when cationic polymers for fixing dyes are added, coarse coalescences tend not to form. Further, alumina or alumina hydrate may be crystalline or non-crystalline, and it is possible to employ particles having other optional shapes such as irregular-shaped particles, spherical particles, and needle-shaped particles.

It is preferable that fine particles in a fine particle dispersion prior to mixing with cationic polymers is dispersed to the state of primary particles.

The diameter of said fine inorganic particles is preferably less than or equal to 100 nm. For example, in the case of said gas phase method produced fine particle silica, the average diameter (the particle diameter in the dispersed state prior to coating) of said primary particles, which have been dispersed, is preferably less than or equal to 100 nm, is more preferably from 4 to 50 nm, and is most preferably from 4 to 20 nm.

The most preferably employed silica, having a primary particle diameter of 4 to 20 nm, which are synthesized employing a gas phase method, is commercially available as, for example, Aerosil of Nippon Aerosil Co. It is possible to relatively easily disperse said gas phase method produced fine particle silica up to primary particles through suction dispersion, employing, for example, Jet Stream Inductor Mixer, manufactured by Mitamura Riken Kogyo Co., Ltd.

Listed as hydrophilic binders are, for example, polyvinyl alcohol, gelatin, polyethylene oxide, polyvinylpyrrolidone, polyacrylic acid, polyacrylamide, polyurethane, dextran, dextrin, Kalageenan (κ, ι, λ), agar, Pullulan, water-soluble polyvinyl butyral, hydroxyethyl cellulose, and carboxymethyl cellulose. These water-soluble resins may be employed in combinations of at least two types.

The water-soluble resins, which are preferably employed in the present invention, are polyvinyl alcohols. Polyvinyl alcohols, which are preferably employed in the present invention, include modified polyvinyl alcohol such as polyvinyl alcohol of which terminals are subjected to cationic modification, anion modified polyvinyl alcohol having an anionic group, other than common polyvinyl alcohol which is prepared by hydrolyzing polyvinyl acetate.

Of polyvinyl alcohols which are prepared by hydrolyzing vinyl acetate, those having an average degree of polymerization of at least 1,000 are preferably employed, and those having an average degree of polymerization of 1,500 to 5,000 are more preferably employed.

Said cation modified polyvinyl alcohol refers to one which has a primary, secondary or tertiary amino group or a quaternary ammonium group in the main chain or the side chain, as described in, for example, Japanese Patent Publication Open to Public Inspection No. 61-10483, and is prepared by hydrolyzing a copolymer of ethylenic unsaturated monomer having a cationic group with vinyl acetate.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(2-dimethylaminopropyl)methacrylamide, hydroxyethyltrimethylammonium chloride, trimethyl-(2-methacrylamidopropyl)ammonium chloride, and N-(1,1-dimethyl-3-dimethylaminopropyl)acrylamide.

The ratio of the cation modified group containing monomers of cation modified polyvinyl alcohol is typically from 0.1 to 10.0 mol percent with respect to vinyl acetate, and is preferably from 0.2 to 5.0 mol percent.

Listed as anion modified polyvinyl alcohols are polyvinyl alcohol having an anionic group, as described in, for example Japanese Patent Publication Open to Public Inspection No. 1-206088, copolymers of vinyl alcohol with vinyl compounds having a water-soluble group, as described in Japanese Patent Publication Open to Public Inspection Nos. 61-237681 and 63-3079799, and modified polyvinyl alcohol having a water soluble group, as described in Japanese Patent Publication Open to Public Inspection No. 7-285265.

Further, listed as nonion modified polyvinyl alcohol are polyvinyl alcohol derivatives which are prepared by adding a polyalkylene oxide group to a part of polyvinyl alcohol, as described in, for example, Japanese Patent Publication Open to Public Inspection No. 7-9758, and block copolymers of vinyl compounds having a hydrophobic group with vinyl alcohol, as described in, for example, Japanese Patent Publication Open to Public Inspection No. 8-25795.

Polyvinyl alcohols, which diffre in their degree of polymerization and their type of modification, may be employed in combination of at least two types.

The added amount of fine inorganic particles, employed in a colorant receptive layer, varies widely depending on the desired ink absorption capacity, the void ratio of the porous layer, the types of fine inorganic particles, and the types of water-soluble resins. However, said added amount is commonly from 5 to 30 g per $m^2$ of the recording sheet, and is preferably from 10 to 25 g.

Further, the ratio of fine inorganic particles to water-soluble resins, employed in said colorant receptive layer, is commonly from 2:1 to 20:1 in terms of weight ratio, and is preferably from 3:1 to 10:1.

Said colorant receptive layer may comprise water-soluble cationic polymers, having a quaternary ammonium salt group in the molecule. They are commonly employed in an amount of 0.1 to 10.0 g per $m^2$ of the ink jet recording sheet, and are preferably employed in an amount of 0.2 to 5.0 g.

In the porous layer, the total void amount (being a void volume) is preferably at least 20 ml per $m^2$ of the recording sheet. When said void volume is less than 20 ml/$m^2$, in the case of a small ink amount, said porous layer exhibits the desired ink absorbability. However, when the ink amount increases, ink is not completely absorbed, and problems tend to occur such that image quality is degraded and the drying rate is lowered.

In the porous layer capable of bearing ink, the void volume with respect to the solid volume is called a void ratio. In the present invention, it is preferable to adjust said void ratio to at least 50 percent so that it is possible to effectively form pores without resulting in an unnecessary increase in the layer thickness.

Besides forming the ink solvent absorptive layer employing fine inorganic particles, as another porous type, an ink solvent absorptive layer may be formed employing a coating composition in which a polyurethane resin emulsion is employed together with water-soluble epoxy compounds and/or acetoacetylated polyvinyl alcohol and further together with epichlorohydrin polyamide resins. In such a case, it is preferable that said polyurethane resin emulsion is comprised of particles of a diameter of 3.0 μm of the polyurethane resin having a polycarbonate chain, as well as said polycarbonate chain and a polyester chain. Further, it is preferable that said polyurethane resin in said polyurethane resin emulsion is prepared by reacting polycarbonate polyol, or polyol having polycarbonate polyol and polyester polyol with aliphatic isocyanate compounds and the resultant polyurethane resin has a sulfonic group in the molecule. It is more preferable that epichlorohydrin polyamide resin, and water-soluble epoxy compounds and/or acetoacetylated polyvinyl alcohol are included.

It is assumed that in the ink solvent absorptive layer employing said polyurethane resin, weak coalescence between cations and anions is formed, and as a result, pores capable of absorbing ink solvents are formed, whereby it is possible to form images.

In the present invention, in order to achieve objectives of the present invention, it is preferable that a layer, comprising thermoplastic resins, is provided on the surface layer of the ink absorptive layer.

The layer, comprising thermoplastic resins may comprise only thermoplastic resins or, if desired, may further comprise water-soluble binders. From the viewpoint of ink penetrability, said thermoplastic resins are preferably in the form of minute particles.

Listed as thermoplastic resins and those in the form of minute particles are, for example, polycarbonate, polyacrylonitrile, polystyrene, polyacrylic acid, methacrylic acid, polyvinyl chloride, polyvinyl acetate, polyester, polyether, and copolymers and salts thereof. Of these, preferred are styrene-acrylic acid ester copolymers, vinyl chloride-vinyl acetate copolymers, vinyl chloride-acrylic acid ester copolymers, ethylene-vinyl acetate copolymers, ethylene-acrylic acid ester copolymers, and SBR latex. Said thermoplastic resins or those in the form of minute particles may be employed in combinations of a plurality of polymers which are different in their monomer composition, particle diameter, and degree of polymerization.

When thermoplastic resins or those in the form of minute particles are selected, it is necessary to take into account ink receptive properties, glossiness of images after heating and pressure fixing, image durability, and releasing properties.

With regard to said ink receptive properties, when the diameter of fine thermoplastic particles is less than 0.05 $\mu$m, the separation rate of ink solvents from pigment particles in pigment ink is decreased, resulting in decreasing the ink absorption rate. On the other hand, it is not preferable that said diameter exceeds 10 $\mu$m, from the viewpoint of adhesion between the ink absorptive layer and the adjacent solvent absorptive layer when applied onto a support, as well as the layer strength of ink jet recording material after coating and drying. As a result, the diameter of fine thermoplastic resin particles is preferably from 0.05 to 10.00 $\mu$m, is more preferably from 0.1 to 5.0 $\mu$m, and is still more preferably from 0.1 to 1.0 $\mu$m.

Further, listed as criteria to select thermoplastic resins and those in the form of fine particles is the glass transition point (Tg). When Tg is lower than the coating drying temperature, for example when the coating drying temperature during production of a recording material has been higher than Tg and pores formed by fine thermoplastic particles, through which ink solvents pass, disappear.

Further, when Tg is higher than the temperature at which a support is modified due to heat, a fixing operation at high temperature is required to carry out melted layer forming. As a result, problems occur with regard to load applied to the apparatus as well as the thermal stability of the support. The Tg of said fine thermoplastic particles is preferably from 50 to 150° C. Further, minimum film forming temperature (MTF) of said particles is preferably from 50 to 150° C.

From the viewpoint of environmental protection, it is preferable that said fine thermoplastic particles are dispersed into a water based medium. Water based latex, which is prepared by emulsion polymerization, is specifically preferred. In such a case, preferably employed may be a type of latex which is prepared by emulsion polymerization, employing nonionic dispersing agents as an emulsifier.

Further, from the viewpoint of avoiding unpleasant odor as well as safety, it is preferable that residual monomer components are minimized. Specifically, the ratio of said residual monomer components is preferably at most 3 percent with respect to the solid weight of polymers, is more preferably at most 1 percent, and is most preferably at most 0.1 percent.

Employed as water-soluble binders may be polyvinyl alcohol and polyvinylpyrrolidone in an amount of 1 to 10 percent of said fine thermoplastic particles.

Preferably employed as recording materials according to the present invention may be those which comprise a support having thereon an ink absorptive layer as well as a surface layer comprising at least inorganic pigment and fine thermoplastic particles.

Listed as particularly preferable reasons are the following points.

(a) Said materials result in a high ink absorption rate, cause minimal image degradation such as beading as well as color bleeding, and have high speed printing adaptability.

(b) The image surface exhibits high strength.

(c) When printed sheets are stored upon being stacked, minimal melt adhesion occurs.

(d) Said materials exhibit desired coating productivity of the ink absorptive layer.

(e) Said materials exhibit desired writability.

In this case, it is preferable that the solid weight ratio of fine thermoplastic particles to inorganic pigments in the surface layer is individually determined depending on employed fine thermoplastic particles, inorganic pigments, and other additives. Said ratio is not particularly limited. However, selection is preferably carried out in a range so that the fine thermoplastic particles/inorganic pigments ratio is from 2/8 to 8/2, is more preferably carried out in the range so that the same is from 3/7 to 7/3, and is still more preferably carried out in the range so that the same is from 4/6 to 6/4.

Colorants employed in the present invention will now be described.

Employed as colorants usable in the present invention may be any of those known in the prior art without any particular limitation. It is possible to employ any of the water-soluble dyes, water-dispersible dyes, water-dispersible pigments, solvent-soluble dyes, solvent-dispersible dyes, and solvent-dispersible pigments. Of these, preferably employed are solvent-dispersible pigments.

These may be employed individually or in combinations of a plurality of types. Of these, particularly preferred colorants are in the form of dispersed particles of dispersible dyes or dispersible pigments. In the following, listed are representative colorants. However, the present invention is not limited to these.

<Direct Dyes>

C.I. Direct Yellow 1, 4, 8, 11, 12, 24, 26, 27, 28, 33, 39, 44, 50, 58, 85, 86, 100, 110, 120, 132, 142, and 144;

C.I. Direct Red 1, 2, 4, 9, 11, 13, 17, 20, 23, 24, 28, 31, 33, 37, 39, 44, 47, 48, 51, 62, 63, 75, 79, 80, 81, 83, 89, 90, 94, 95, 99, 220, 224, 227, and 243;

C.I. Direct Blue 1, 2, 6, 8, 15, 22, 25, 71, 76, 78, 80, 86, 87, 90, 98, 106, 108, 120, 123, 163, 165, 192, 193, 194, 195, 196, 199, 200, 201, 202, 203, 207, 236, and 237;

C.I. Direct Black 2, 3, 7, 17, 19, 22, 32, 38, 51, 56, 62, 71, 74, 75, 77, 105, 108, 112, 117, and 154.

<Acid Dyes>

C.I. Acid Yellow 2, 3, 7, 17, 19, 23, 25, 29, 38, 42, 49, 59, 61, 72, and 99;

C.I. Acid Orange 56 and 64;

C.I. Acid Red 1, 8, 14, 18, 26, 32, 37, 42, 52, 57, 72, 74, 80, 87, 115, 119, 131, 133, 134, 143, 154, 186, 249, 254, and 256;

C.I. Acid Violet 11, 34, and 75;

C.I. Acid Blue 1, 7, 9, 29, 87, 126, 138, 171, 175, 183, 234, 236, and 249;

C.I. Acid Green 9, 12, 19, 27, and 41;

C.I. Acid Black 1, 2, 7, 24, 26, 48, 52, 58, 60, 94, 107, 109, 110, 119, 131, and 155.

<Reactive Dyes>

C.I. Reactive Yellow 1, 2, 3, 13, 14, 15, 17, 37, 42, 76, 95, 168, and 175;

C.I. Reactive Red 2, 6, 11, 21, 22, 23, 24, 33, 45, 111, 112, 114, 180, 218, 226, 228, and 235;

C.I. Reactive Blue 7, 14, 15, 18, 19, 21, 25, 38, 49, 72, 77, 176, 203, 220, 230, and 235;

C.I. Reactive Orange 5, 12, 13, 35, and 95;

C.I. Reactive Brown 7, 11, 33, 37, and 46;

C.I. Reactive Green 8 and 19;

C.I. Reactive Violet 2, 4, 6, 8, 21, 22, and 25;

C.I. Reactive Black 5, 8, 31, and 39.

<Basic Dyes>

C.I. Basic Yellow 11, 14, 21, and 32;

C.I. Basic Red 1,2, 9, 12, and 13;

C.I. Basic Violet 3, 7, and 14;

C.I. Basic Blue 3, 9, 24, and 25.

In addition, listed as ink dyes employed in the present invention may be chelate dyes and azo dyes employed in so-called silver dye bleach method light-sensitive materials (for example, Cibachrome manufactured by Ciba-Geigy).

For example, British Patent No. 1,077,484 may be used as a reference with regard to chelate dyes.

For example, British Patent Nos. 1,039,458, 1,004,957, and 1,077, and U.S. Pat. No. 628, 2,612,448 may be used as a reference with regard to silver dye bleach light-sensitive material azo dyes.

The content ratio of water-soluble dyes employed in the ink of the present invention is preferably from 1 to 15 percent by weight with respect to the total weight of the ink.

Listed as disperse dyes, which are preferably employed in the present invention, are, for example:

C.I. Disperse Yellow 3, 4, 5, 7, 9, 13, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 114, 116, 118, 119, 122, 124, 126, 135, 140, 141, 149, 160, 162, 163, 164, 165, 179, 180, 182, 183, 186, 192, 198, 199, 202, 204, 210, 211, 215, 216, 218, and 224;

C.I. Disperse Orange 1, 3, 5, 7, 11, 13, 17, 20, 21, 25, 29, 30, 31, 32, 33, 37, 38, 42, 43, 44, 45, 47, 48, 49, 50, 53, 54, 55, 56, 57, 58, 59, 61, 66, 71, 73, 76, 78, 80, 89, 90, 91, 93, 96, 97, 119, 127, 130, 139, and 142;

C.I. Disperse Red 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 298, 302, 303, 310, 311, 312, 320, 324, and 328;

C.I. Disperse Violet 1, 4, 8, 23, 26, 27, 28, 31, 33, 35, 36, 38, 40, 43, 46, 48, 50, 51, 52, 56, 57, 59, 61, 63, 69, and 77;

C.I. Disperse Green 9;

C.I. Disperse Brown 1, 2, 4, 9, 13, and 19;

C.I. Disperse Blue 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, and 333; and C.I. Disperse Black 1, 3, 10, and 24.

From the viewpoint for obtaining desired glossiness, preferably employed as colorants used in the present invention are pigments. Further, preferably employed as pigments used in pigment ink may be insoluble pigments, organic pigments such as lake pigments and carbon black.

Insoluble pigments are not particularly limited. Preferred are, for example, azo, azomethine, methine, triphenylmethane, triphenylmethane, quinacridone, anthraquinone, perylene, indigo, quinophtharone, isoindolinone, isoindoline, azine, oxazine, thiazine, dioxazine, thiazole, phthalocyanine, and diketopyrolopyrrole.

Listed as specific pigments which are preferably employed are those in the following.

Listed as pigments for magenta or red are, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1; C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are, for example, C.I. Pigment Orange 31, C.I. Pigment Orange 43, C.I. Pigment Yellow 12, C.I. Pigment Yellow 13, C.I. Pigment Yellow 15, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, and C.I. Pigment Yellow 138.

Listed as pigments for green or cyan are, for example, C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Other than these, listed are, for example, carbon black pigments (C.I. Pigment Black 7); C.I. Pigment Yellow 12, 13, 14, 16, 17, 73, 74, 75, 83, 108, 109, 110, 180, 182; C.I. Pigment Red 5, 7, 12, 112, 123, 168, 184, and 202; C.I. Pigment Blue 1, 2, 3, 15:3, 16, 22, and 60; and C.I. Vat Blue 4 and 60.

When other than these pigments, red, green, blue, and intermediate colors are needed, the pigments shown below are employed individually or in combination.

For example, employed are

C.I. Pigment Red 209, 224, 177, and 194;

C.I. Pigment Orange 43;

C.I. Vat Violet 3;

C.I. Pigment Violet 19, 23, and 37;

C.I. Pigment Green 36 and 7; and

C.I. Pigment Blue 15:6.

It is preferable that pigments as well as disperse dyes employed in the present invention are dispersed together with dispersing agents and additives necessary for achieving desired purposes, employing a homogenizer and subsequently employed. Employed as homogenizers may be ball mills, sand mills, line mills, and high pressure homogenizers which are known in the prior art.

Employed as said dispersing agents are surface active agents. Employed as surface active agents used in the present invention may be any of the cationic, anionic, amphoteric, or nonionic ones. Listed as cationic surface active agents are aliphatic amine salts, aliphatic quaternary ammonium salts, benzalkonium salts, benzethonium chloride, pyridium salts, and imidazolium salts. Listed as anionic surface active agents are fatty acid soap, N-acyl-N-methylglycine salts, N-acyl-N-methyl-β-alanine salts, N-acylglutamic acid salts, acylated peptides, alkyl sulfonate, alkylbenzenesulfonates, alkylnaphthalenesulfonates, dialkyl sulfosuccinates, alkyl sulfoacetates, α-olefinsulfonates, N-acylmethyltaurine, sulfonated oil, higher alcohol sulfonates, secondary higher alcohol sulfonates, alkyl ether sulfonates, secondary higher alcohol ethoxysulfates, polyoxyethylene alkyl phenyl ether sulfates, monoglysulfates, fatty acid alkylolamidosulfates, alkyl ether phosphates, and alkyl phosphates. Listed as amphoteric surface active agents are carboxybetaine types, sulfobetaine types, aminocarboxylates, and imidazolium betaine. Listed as nonionic surface active agents are polyoxyethylene secondary alcohol ether, polyoxyethylene alkyl phenyl ether, polyoxyethylene sterol ether, polyoxyethylene lanoline derivative polyoxyethylene polyoxypropylene alkyl ether, polyoxyethylene glycerin fatty acid esters, polyoxyethylene castor oil, hardened castor oil, polyoxyethylene sorbitol fatty acid esters, polyethylene glycol fatty acid esters, fatty acid monoglycerides, monoglycerin fatty said esters, sorbitan fatty acid esters, propylene glycol fatty acid esters, sugar fatty acid esters, fatty acid alkanolamide, polyoxyethylene fatty acid amides, polyoxyethylene alkylamine, alkylamine oxides, acetylene glycol, and acetylene alcohol.

Further, for example, when said colorants are employed as ink for ink jet printing, in order to accelerate penetration of ink droplets into a medium after ink ejection, it is preferable to use surface active agents. Such surface active agents are not particularly limited as long as the storage stability of ink comprising said surface active agents is not adversely affected, and surface active agents analogous to those employed as said dispersing agents are employed.

In the present invention, it is possible to use electric conductivity controlling agents. Said electric conductivity controlling agents include, for example, inorganic salts such as potassium chloride, ammonium chloride, sodium sulfate, sodium nitrate, and sodium chloride, and water-soluble amines such as triethanolamine.

Viscosity modifiers, resistivity controlling agents, layer forming agents, UV absorbers, antioxidants, anti-discoloring agents, rust inhibitors, and antiseptic agents may also be incorporated in the ink employed in the present invention, depending on the purposes to improve the ejection stability, the adaptability of printing heads and ink cartridges, the storage stability, and the image retention properties.

The ink employed in the present invention is comprised of water and water-soluble organic solvents as major liquid medium components. Listed as water-soluble organic solvents are alkyl alcohols having from 1 to 4 carbon atoms (for example, methyl alcohol, ethyl alcohol, n-propyl alcohol, isopropyl alcohol, n-butyl alcohol, sec-butyl alcohol, tert-butyl alcohol, and isobutyl alcohol), amides (for example, dimethylformamide, and dimethylacetamide), ketone or keto alcohols (for example, acetone diacetone alcohol), ethers (for example, tetrahydrofuran, and dioxane), polyalkylene glycols (for example, polyethylene glycol and polypropylene glycol), alkylene glycols in which an alkylene group has from 2 to 6 carbon atoms (for example, ethylene glycol, propylene glycol, butylenes glycol, triethylene glycol, 1,2,6-hexanetriol, thiodiglycol, hexylene glycol, and diethylene glycol), glycerin, lower alkyl ethers of polyhydric alcohols (such as ethylene glycol methyl ether, diethylene glycol methyl (or ethyl) ether, and triethylene glycol monomethyl (or ethyl) ether).

Of a number of said water-soluble organic solvents, preferred are polyhydric alcohols such diethylene glycol and lower alkyl ethers of polyhydric alcohols such as triethylene glycol monomethyl (or ethyl) ether.

The proportion of said water-soluble organic solvents is commonly from 10 to 70 percent by weight with respect to the total weight of the ink, is more preferably from 30 to 65 percent by weight, and is most preferably from 40 to 60 percent.

For the purpose of enhancing ink adhesion into an image transferring medium and image durability on said image transferring medium, it is preferable that thermoplastic resinous particles be incorporated in the ink for ink jet printing which is employed in the present invention. Further, it is particularly preferable that dispersed particles of colorants are subjected to resin coating. Said thermoplastic resinous particles may be combined with any of the dissolved dye systems, the dispersed dye systems, or the dispersed pigment systems. Further, said resin coating may most suitably apply to the dispersion dye systems and dispersion pigment systems. In order to stabilize liquid physical properties at room temperature, the melting point of said thermoplastic resins is preferably at least 30° C., and is more preferably at least 40° C. Listed as said thermoplastic resins may be those which are employed in the transfer layer described below. Without any particular limitation, employed as coating agents of particles employing in said resin coating may be thermoplastic resins, which are known in the prior art, having a melting point of at least 50° C. The melting point of said resins is more preferably at least 50° C. Listed as thermoplastic resins may be, for example, acrylate based resins, methacrylate based resins, styrene based resins, styrene-acryl copolymers, styrene-butadiene copolymers, acrylonitrile-butadiene copolymers, polybutadine, vinyl acetate, polyvinyl chloride, polyvinylidene chloride, ethylene-vinyl acetate copolymers, homopolymers or copolymer resinous emulsions having hydrophilic functional groups such olefin based or an amino group, an amido group, a carboxyl group, and a hydroxyl group, microemulsions, natural or synthetic wax emulsions of fine organic particles having three-dimensional crosslinking in their interior, paraffin wax, polyethylene wax, carnauba wax, latexes, colloid compositions, and suspensions.

Employed as ink, used to form images, may be water based ink compositions, oil based ink compositions, and solid (phase change) ink compositions. Of these, water based ink compositions (for example, water based recording liquid for ink jet printing which comprises water in an amount of at least 10 percent by weight of the total ink weight) is most preferably employed.

If desired, pigment dispersing agents may be employed for said pigments. Listed as usable pigment dispersing agents are, for example, surface active agents such as higher fatty acid salts, alkyl sulfates, alkyl sulfonates, sulfosuccinates, naphthalenesulfonates, alkyl phosphates, polyoxyalkylene alkyl ether phosphates, polyoxyalkylene alkyl phenyl ether, polyoxyethylene polyoxypropylene glycol, glycerin ester, sorbitan ester, polyoxyethylene fatty acid amide, and amine oxide, or block copolymers and random copolymers comprised of at least two types of monomers selected from the group consisting of styrene, styrene derivatives, vinylnaphthalene derivatives, acrylic acid, acrylic acid derivatives, maleic acid, maleic acid derivatives, itaconic acid, itaconic acid derivatives, fumaric acid, and fumaric acid derivatives, and salts thereof.

Methods for dispersing said pigments are not particularly limited. Employed as said methods may be, for example, various methods employing, for example, a ball mill, a sand mill, an attriter, a roll mill, an agitator, a Henschel mixer, a colloid mill, an ultrasonic homogenizer, a pearl mill, a wet type jet mill, and a paint shaker.

For the purpose of removing any coarse particle portion in the pigment dispersion, according to the present invention, employing a centrifuge, as well as employing filters, is also a preferable method.

The average diameter of pigment particles in the pigment ink is determined while taking into account the stability in said ink, the image density, the gloss, and the lightfastness. In the method for forming ink jet pigment images of the present invention, it is further preferable that said particle diameter is determined while taking into account the enhancement of gloss as well as image quality. In the present invention, reasons of enhancing the gloss as well as image quality have not been yet clarified. However, it is assumed that said enhancement relates to the fact that pigments in images are dispersed into the layer which is formed by melting fine thermoplastic particles. When a high speed process is aimed, it is desired that in a short time, fine thermoplastic particles are melted so as to form a layer, and further, pigments are sufficiently dispersed into the resultant layer. During this process, the surface area of pigment particles plays an important role, and therefore there is an optimal range of the average particle diameter.

When a water based ink composition, which is the preferable form as a pigment ink, is prepared, it is preferable to use water-soluble organic solvents as a component.

Listed as water-soluble organic solvents are, for example, alcohols (for example, methanol, ethanol, propanol, isopropanol, butanol, isobutanol, secondary butanol, tertiary butanol, pentanol, hexanol, cyclohexanol, and benzyl alcohol); polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, and thiodiglycol); polyhydric alcohol ethers (for example, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, and propylene glycol monophenyl ether); amines (for example, ethanolamine, diethanolamine, triethanolamine, N-methyldiethanolamine, N-ethyldiethanolamine, morpholine, N-ethylmorpholine, ethylenediamine, diethylenediamine, triethylenetetraamine, tetraethylenepentaamine, polyethyleneimine, pentamethyldiethylenetriamine, and tetramethylpropylenediamine); amides (for example formamide, N,N-dimethylformamide, and N,N-dimethylacetamide); heterocyclic rings (for example, 2-pyrrolidone, N-methyl-2-pyrrolidone, cyclohexylpyrrolidone, 2-oxazolidone, and 1,3-dimethyl-2-imidazolidinone); sulfoxides (for example, dimethylsufoxide); sulfones (for example, sulfolane); urea; acetonitrile; and acetone. Listed as preferred water-soluble organic solvents are polyhydric alcohols. Further, it is particularly preferred that polyhydric alcohol is employed together with polyhydric alcohol ether.

Said water-soluble organic solvents may be employed individually or in combinations of a plurality of those. The added amount of said water-soluble solvents in ink is typically from 5 to 60 percent by weight in total, and is preferably from 10 to 35 percent by weight.

Fine thermoplastic particles, viscosity modifiers, surface tension controlling agents, resistivity controlling agents, layer forming agents, dispersing agents, surface active agents, UV absorbers, antioxidants, anti-discoloring agents, rust inhibitors, and antiseptic agents may be suitably incorporated in said ink compositions, depending on the intent to improve the ejection stability, the adaptability of printing heads and ink cartridges, the storage stability, and the image retention properties.

Addition of fine thermoplastic particles is particularly preferred to result in the desired effects of the present invention. Employed as said fine thermoplastic particles may be those which can be incorporated in the surface layer of the aforesaid recording materials, or types of those described in the aforesaid fine particles. Specifically, it is preferable to employ those which result in neither an increase in viscosity nor precipitation, when added to ink. The average diameter of said thermoplastic particles is preferably less than or equal to 0.5 $\mu$m, and is more preferably in the range of 0.2 to 2.0 times of average diameter of pigment particles in the ink, from the viewpoint of stability. Fine thermoplastic particles, to be added, preferably melt or soften in the range of 50 to 200° C.

The viscosity of said ink compositions during its injection is preferably less than or equal to 40 mPa·s, and is more preferably less than or equal to 30 mPa·s.

The surface tension of said ink compositions during its ejection is preferably at least 20 mN/m, and is more preferably from 30 to 45 mN/m.

The selectable range of solid concentration of pigments in ink is from 0.1 to 10.0 percent by weight. In order to obtain images approaching conventional photography, it is preferable to employ so-called dense and pale inks in which the solid concentration of pigments are individually varied. It is particularly preferable to employ said dense and pale inks for each of yellow, magenta, cyan, and black. Further, if desired, it is preferable to employ specified color inks such as red, green, and blue.

The thermal fixing apparatus of the present invention will now be described.

In order to result in effects described in the present invention, namely to prepare images with desired glossiness after fixing, the thermal fixing apparatus, according to the present invention, is characterized in being comprised of at least one of the Fixing belt and the fixing roller according to the present invention as a constituting component.

During the thermal fixing process, it is desired that energy be provided to images so that the effects of the present invention are fully exhibited. Heating temperature, especially in the case of pigment images, may be one capable of smoothing images, is preferably in the rang of 60 to 200° C., and is more preferably in the range of 80 to 160° C.

Heating may be carried out employing a heating unit installed in the printer or independently provided. In either case of employing said fixing roller or said fixing belt, it is preferable to employ heating rollers as a heating means so that unevenness is minimized and continuous processing can be carried out in a small space. Further, said unit is advantageous in terms of cost, since thermal fixing units employed in electrophotographic apparatuses may be employed as said unit.

Said heating roller comprises a hollow roller as a constituent component and is rotated by a driving means. It is preferable that a heat generating device comprised of, for example, a halogen lamp heater, a ceramic heater, or a nichrome wire heater is provided in the hollow section.

Further, said roller is preferably comprised of materials having a high thermal conductivity. Of these, metal rollers are particularly preferred and of these, a nickel roller is preferably employed.

When such a fixing belt or fixing roller is employed, the transport rate of recording materials is preferably in the range of 1 to 100 mm/second, and is more preferably in the range of 10 to 50 mm/second. Said rate is preferred from the viewpoint of image quality in addition to high speed processing.

In order to achieve higher sensation in quality as well as higher gloss, it is preferable that pressing is carried out at the same time of or immediately after heating. Pressing pressure is preferably in the range of $9.8\times10^4$ to $4.9\times10^6$ Pa, since higher pressure accelerates film formation.

The image forming method of the present invention will now be described.

The image forming method of the present invention is characterized in that during fixing of images, the thermal fixing apparatus, according to the present invention, is employed. In the present invention, for example, when images are formed employing a pigment ink for ink jet printing, printers are not particularly limited as long as said printers comprise a recording material storing section, a transport section, an ink cartridge, and an ink jet printing head as seen in commercially available printers. However, a printer comprising, in addition, a set of the following sections is useful when ink jet prints are used commercially: at least a rolled recording material storing section, a transport section, an ink jet printing head, a cutter section, and if desired, a heating section, a pressing section, and a recorded print storing section.

Said printing head may use any of the piezoelectric system, the thermal system or the continuous system. However, from the viewpoint of stability of pigment ink, the piezoelectric system is preferred.

It is preferable that the C value described below is increased after printing, employing any of the available processes described below. Said available processes include those in which images are heated or pressed, or images are subjected to both; or solvents or plasticizers are provided and additional heating is carried out; or thermoplastic resin components are provided onto images and additional heating is carried out. Further, such processes may be combined with each other and said processes may be carried out a plurality of times.

Further, in the image forming method of the present invention, it is preferable that after printing images onto a recording material, employing a pigment ink, said recording material is thermally fixed employing the thermal fixing apparatus of the present invention. In said image forming method, it is preferable that pigment images, in which pigments and thermoplastic resins are mixed or which are located near said pigments and thermoplastic resins, are subjected to thermal fixing process. In such a case, it is preferable that said thermoplastic resins partially or completely melt and further form a layer.

Listed as methods in which pigment images are allowed to exist together with thermoplastic resins are: 1) a recording material is employed which comprises thermoplastic resins, or preferably fine thermoplastic particles, 2) prior to or after printing, thermoplastic resins are provided onto said recording material, and 3) thermoplastic resins are incorporated in said pigment ink.

In the present invention, the image definition called C value is preferably at least 60. Said C value, as described herein, refers to the value determined by the reflection method employing a 2 mm optical comb of image definitions specified in JIS K 7105. Said C value is defined as the scale of image clarity.

Image clarity, as described in the present invention, represents the capability of the layer surface which transfers the image of a body facing the layer surface, namely the value which shows how accurately an incident image is reflected or projected on the image surface. The more accurate the reflection images are provided, with respect to the incident image, the higher the image transfer properties become, and as a result, said C value increases. Said C value represents combined effects of specular glossiness and surface smoothness. The higher the reflectance and the higher the smoothness, the more said C value increases.

The inventors of the present invention investigated various pigment images prepared by ink jet printing, having different C values and discovered that along with an increase in said C value, gloss increases, and it was possible to prepare images nearly equal to conventional silver halide photography. Further, surprisingly, along with an increase in said C value, it was discovered that bronzing phenomena, which were specific to pigment ink was minimized. Still further, along with an increase in said C value, it was discovered that image retaining properties such as waterfastness as well as acidic gas resistance was improved.

Pigments images having a C value of at least 60 are capable of resulting the effects which are the aim of the present invention. However, said C value is preferably from 70 to 90, and is more preferably from 75 to 90.

Methods to achieve a C value of at least 60, specified in the present invention, are not particularly limited. For example, after printing images onto a recording material employing ink pigments, it is possible to obtain the target C value employing methods in which after printing images onto a printing material employing ink pigment, the resultant images are heated or pressed, or said images are subjected to both processes; or solvents or plasticizers are provided onto images and additional heating is carried out; or thermoplastic resin components are provided onto images and additional heating is carried out. Further, such processes may be combined with each other or said processes may be carried out a plurality of times.

EXAMPLES

Example 1

The present invention will now be described with reference to examples. However, the present invention is not limited to these examples.

<<Production of Fixing Belt>>

(Production of Fixing Belt 106)

One L of a release agent (trade name: KS-830E, manufactured by Shin-Etsu Kagaku Kogyo Co.) for release paper sheets was mixed with 10 ml of a catalyst (trade name: CAT-PL-50T, also manufactured by Shin-Etsu Kagaku Kogyo Co.), and the volume of the resultant mixture was adjusted to 5 L by adding toluene. The resultant mixture was placed in a cylindrical beaker of an interior diameter of 15 cm and a height of 50 cm. A ϕ65 mm×230 mm seamless nickel belt was installed in a commercially available dip type coater, and said belt was lowered and dipped into said composition in said beaker. Subsequently, while pulling up said belt at a rate of 10 mm/second, coating was carried out. After setting the coating aside at room temperature for 5 minutes, the resulting coating was subjected to thermal hardening at 120° C. for one hour in an oven, whereby Fixing Belt 106, which had the surface layer as shown in FIG. 1, was produced.

The peel strength of the surface layer of obtained Fixing Belt 106 was 450 g/5 cm and the coating thickness was 0.5 μm.

(Production of Fixing Belts 101 through 105 and 107 through 113)

Fixing Belts 101 through 105 and 107 through 113 were prepared in the same manner as Fixing Belt 106, except that the types of release agents for release paper sheets were varied, and catalysts, diluting solvents, hardening temperature, and hardening time were suitably varied, employing said release agents, so as to obtain peel strength as well as pencil hardness value shown in Table 1.

When Fixing Belts 101 through 113, prepared as above, were evaluated, each of the ink jet recording materials and the ink for ink jet printing was prepared as described below.

<<Preparation of Ink Jet Recording Material>>

After preparing each dispersion employing the formula described below, an ink jet recording material was prepared employing each of the resultant dispersions.

<Preparation of Silica Dispersion 1>

Suction-dispersed 125 kg of gas phase method produced silica (QS-20, manufactured by Tokuyama Co., Ltd.), having an average diameter of primary particles of 0.012 μm, was into 620 L of pure water of which pH was adjusted to 2.5 by adding nitric acid, employing Jet Stream Inductor Mixer TDS, manufactured by Mitamura Riken Kogyo Co., Ltd. Subsequently, the total volume of the resultant dispersion was adjusted to 694 L by adding pure water. The resultant dispersion was designated as Silica Dispersion 1.

<Preparation of Silica Dispersion 2>

Under stirring, 69.4 L of Silica Dispersion 1 was added to 18 L of an aqueous solution (at a pH of 2.3) consisting of 1.14 kg of Cationic Polymer (P-l), 2.2 L of ethanol, and 1.5 L of n-propanol, and subsequently, 7.0 L of an aqueous solution comprising 260 g of boric acid and 230 g of borax was added, and 1 g of antifoaming agent SN381 (manufactured by Sun Nopco Co., Ltd.) was also added.

The resultant mixture was dispersed employing a high pressure homogenizer, manufactured by Sanwa Kogyo Co., Ltd., and the total volume of the resultant dispersion was adjusted to 97 L by adding pure water, whereby Silica Dispersion 2 was prepared.

P-1

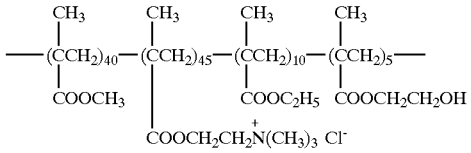

<Preparation of Silica Coating Composition>

Subsequently, the silica coating composition, described below, was prepared employing Silica Dispersion 2 prepared as above.

While stirring, the additives described below were successively added to 600 ml of Silica Dispersion 2.

(1) 6 ml of 10 percent aqueous solution of polyvinyl alcohol (PVA 203, manufactured by Kuraray Kogyo Co., Ltd.),
(2) 185 ml of 7 percent aqueous solution of polyvinyl alcohol (PVA 235 manufactured by Kuraray Kogyo Co., Ltd.), and subsequently
(3) the total volume was adjusted to 1,000 ml by adding pure water.

<Fine Thermoplastic Particle Coating Composition>

The pH of a styrene-acryl based latex polymer (having a Tg of 78° C., an average particle diameter of 250 nm, and a solid concentration of 40 percent), prepared by emulsion polymerization employing polyvinyl alcohol as a nonionic emulsifier, was adjusted to 4.7, by adding 6 percent aqueous nitric acid solution, whereby a fine styrene-acryl based thermoplastic particle coating composition was prepared.

<Preparation of Fine Composite Particle Coating Composition>

A fine composite particle coating composition was prepared by blending said fine thermoplastic particle coating composition with said silica coating composition so that the resultant solid weight ratio was 2/1.

(Preparation of Ink Jet Recording Material 1)

Said silica coating composition and said fine composite particle coating composition in the order viewed from the polyethylene coated paper, described below, were simultaneously applied onto said polyethylene coated paper so as to obtain a wet coating thickness of 120 μm and 120 μm, respectively. The resultant coating was temporarily cooled to approximately 7° C. and subsequently was dried employing a 20 to 65° C. airflow, whereby Ink Jet Recording Material 1 was prepared. Said polyethylene coated paper was comprised of a 170 g/m$^2$ base paper coated with polyethylene on both sides (8 weight percent of anatase type titanium dioxide was incorporated in the polyethylene on the ink receptive layer side; 0.05 g/m$^2$ gelatin sublayer was provided on the ink receptive layer side; and on the opposite side, provided was a backing layer comprised of latex polymers of a Tg of approximately 80° C. at a coating weight of 0.2 g/m$^2$).

<<Preparation of Ink for Ink Jet Printing>>

Ink compositions were prepared as described below.

(Yellow Pigment Dispersion)

| | |
|---|---|
| C.I. Pigments Yellow 74 | 95 g |
| Demol C (manufactured by Kao Corp.) | 65 g |
| Ethylene glycol | 100 g |
| Deionized water | 120 g |

were blended and dispersed employing a sand grinder filled with 0.5 mm zirconia beads at a volume ratio of 50 percent, whereby a yellow pigment dispersion was prepared. The average particle diameter of the obtained pigment dispersion was 122 nm. Incidentally, the particle diameter was determined employing a Zeta Sizer 1000, manufactured by Malvern Instruments Inc.

(Magenta Pigment Dispersion)

| | |
|---|---|
| C.I. Pigments Red 122 | 105 g |
| Johncryl 61 (acryl-styrene based resin, manufactured by Johnson Corp.) | 60 g |
| Glycerin | 100 g |
| Deionized water | 130 g |

were blended and dispersed employing a sand grinder filled with 0.5 mm zirconia beads at a volume ratio of 50 percent, whereby a magenta pigment dispersion was prepared. The average particle diameter of the obtained pigment dispersion was 85 nm.

(Cyan Pigment Dispersion)

| | |
|---|---|
| C.I. Pigment Blue 15:3 | 100 g |
| Demol C | 68 g |
| Diethylene glycol | 100 g |
| Deionized water | 125 g |

were blended and dispersed employing a sand grinder filled with 0.5 mm zirconia beads at a volume ratio of 50 percent, whereby a cyan pigment dispersion was prepared. The average particle diameter of the obtained pigment dispersion was 105 nm.

<Preparation of Yellow Ink>

| | |
|---|---|
| Yellow Pigment Dispersion | 113 g |
| Ethylene glycol | 100 |
| Glycerin | 72 g |
| Pelex OT-P (manufactured by Kao Corp.) | 3 g |
| Proxel GXL (manufactured by Zeneca Corp.) | 0.2 g |
| Deionized water to make | 1000 g |

The resultant mixture was stirred well, and yellow ink was prepared by twice passing said mixture through a Millipore Filter having a pore diameter of one micron. The pH of the ink was 8.2.

<Preparation of Cyan Ink>

| | |
|---|---|
| Cyan Pigment Dispersion | 113 g |
| Ethylene glycol | 100 |
| Glycerin | 72 g |
| Pelex OT-P (manufactured by Kao Corp.) | 3 g |
| Proxel GXL (manufactured by Zeneca Corp.) | 0.2 g |
| Deionized water to make | 1000 g |

The resultant mixture was stirred well, and cyan ink was prepared by twice passing said mixture through a Millipore Filter having a pore diameter of one micron. The pH of the ink was 8.3.

<Preparation of Magenta Ink>

| | |
|---|---|
| Magenta Pigment Dispersion | 113 g |
| Ethylene glycol | 100 |
| 1,2-Hexanediol | 100 g |
| Pelex OT-P (manufactured by Kao Corp.) | 3 g |
| Proxel GXL (manufactured by Zeneca Corp.) | 0.2 g |
| Deionized water to make | 1000 g |

The resultant mixture was stirred well, and magenta ink was prepared by twice passing said mixture through a Millipore Filter having a pore diameter of one micron. The pH of the ink was 8.5.

<Preparation of Black Ink>

| | |
|---|---|
| Hostifine Black T (having an average particle diameter of 50 nm, manufactured by Clariant Co., Ltd.) | 167 g |
| 1,2-Hexanediol | 150 g |
| Ethylene glycol | 220 g |
| Diethylene glycol | 90 g |
| LEVENOL WX (manufactured by Kao Corp.) | 3 g |
| Proxel GXL (manufactured by Zeneca Corp.) | 0.2 g |
| Deionized water to make | 1000 g |

The resultant mixture was stirred well, and magenta ink was prepared by twice passing said mixture through a Millipore Filter having a pore diameter of one micron. The pH of the ink was 8.6.

(Preparation of Image Samples 101 through 113)

Each of Fixing Belts 101 through 113, prepared as above, was installed in an ink jet printer fitted with the thermal fixing apparatus described in FIG. 1. Employing ink for ink jet printing, a solid black image was printed onto ink jet recording material 1 and was thermally fixed employing the fixing apparatus in said printer, whereby Image Samples 101 through 113 were prepared. The temperature of the heating roller, which transmits heat onto the fixing belt, was set at 120° C.

Glossiness as well as offsetting properties to the Fixing Belt during thermal fixing was evaluated as described below.

(Evaluation of Glossiness)

The image clarity (glossiness C value in percent) of each of Image Samples 101 through 113 was determined at a reflection angle of 60 degrees and an optical comb of 2 mm, employing an image clarity meter ICM-IDP (manufactured by Suga Shikenkikai Co., Ltd.). Evaluation was performed based on the criteria described below.

<Evaluation of Offsetting>

Employing A4 plain paper sheets, a solid black image was continuously printed onto five sheets. Images after the thermal fixing process as well as the surface of the Fixing Belt was visually observed and the presence or absence of offsetting was evaluated based on the rank listed below.

A: offsetting was not noticed on images as well as on the fixing belt

B: offsetting was not noticed in images but was slightly noticed on the fixing belt C: offsetting was not noticed on images but was noticed on the fixing belt (being commercially practicable).

Table 1 shows the evaluation results.

TABLE 1

| Sample No. | Surface Layer: Release agent for Release Paper | Peel Strength g/5 cm | Pencil Hardness | Contact Angle in Degree | Surface Roughness (μm) | Thickness (μm) | Glossiness | Offsetting |
|---|---|---|---|---|---|---|---|---|
| 101 | KS-835 | 21 | B | 130 | 0.05 | 19 | 46 | C |
| 102 | KS-3650 | 24 | B | 125 | 0.05 | 20 | 48 | C |
| 103 | KS-882 | 40 | 3H | 105 | 0.05 | 25 | 68 | B |
| 104 | KS-3703 | 200 | H | 118 | 0.05 | 23 | 73 | A |
| 105 | KS-839 | 300 | 2H | 117 | 0.05 | 22 | 83 | A |
| 106 | KS-830E | 450 | 2H | 111 | 0.05 | 0.5 | 67 | B |
| 107 | KS-830E | 450 | 2H | 111 | 0.05 | 5 | 75 | A |
| 108 | KS-830E | 450 | 2H | 111 | 0.05 | 22 | 88 | A |
| 109 | KS-830E | 450 | 2H | 111 | 0.05 | 49 | 84 | A |
| 110 | KS-830E | 450 | 2H | 111 | 0.05 | 67 | 65 | B |
| 111 | KS-830E | 450 | 2H | 111 | 0.2 | 22 | 66 | B |
| 112 | KS-830E | 450 | 2H | 111 | 0.3 | 22 | 59 | C |
| 113 | UVHC 1105 (manufactured by Toshiba Silicone Co. | 25 | B | 111 | 0.3 | 22 | 40 | C |

As can clearly be seen from Table 1, when images were formed employing the fixing belt having a peel strength of the surface layer of at least 30 g/5 cm, image samples as well as the fixing belts exhibited high glossiness and minimal offsetting.

Example 2

<Production of Fixing Belt>

(Production of Fixing Belt 202)

Placed in a cylindrical beaker of an interior diameter of 15 cm and a height of 50 cm. was 5 L of a primer composition (trade name: PC-7A, manufactured by Shin-Etsu Kagaku Kogyo Co.). A ϕ65 mm×239 mm seamless nickel belt as a fixing belt base material was installed in a dip type coater. Subsequently, said belt was lowered and dipped into the composition in said beaker, and subsequently, was pulled up at a rate of 10 mm/second so as to be coated. The resultant coating was put aside at room temperature for 5 minutes, and subsequently was subjected to hardening at 120° C. for one hour in an oven, whereby a nickel belt with a primer layer was prepared.

Subsequently, a surface layer was formed on said primer layer in the same manner as the production of Fixing Belt 106 of Example 1, whereby Fixing Belt 202 was prepared.

(Production of Fixing Belts 201, 203, and 204) Each of Fixing Belts 201, 203, and 204 was produced in the same manner as Fixing Belt 202, except that the type of release agent and the coating of the primer layer employed in the production of Fixing Belt 202 were varied as described in Table 2.

(Preparation of Image Samples 201 through 204)

Each of Fixing Belts 201 through 204, prepared as above, was installed in an ink jet printer fitted with the thermal fixing apparatus described in FIG. 1. In the same manner as Example 1, a solid black image was printed and was thermally fixed employing a fixing apparatus in said printer, whereby Image Samples 201 through 204 were prepared. Herein, temperature of the heating roller, which transmits heat onto the fixing belt, was adjusted to 120° C.

When each of Image Samples 201 through 204 was thermally fixed, belt layer peeling on the fixing belt was evaluated as described below.

<<Belt Layer Peeling>>

In the same manners as the offsetting evaluation of Example 1, 5 solid black images were continuously printed onto A4 plain paper sheets. Thereafter, a 3×3 cm adhesive tape (Nitto Polyester Tape No. 31B, manufactured by Nitto Denko Co., Ltd.) was adhered onto the surface layer without including air and subsequently was strongly pulled. Said adhering and pulling operation was repeated, and after each operation, the degree of layer peeling was visually evaluated based on the rank described below.

A: no layer peeling was noticed after 10 pulling operations

B: no layer peeling was noticed until 5 pulling operations

C: no layer peeling was noticed at the first operation, but layer peeling was noticed within 5 pulling operations.

Table 2 shows the results.

TABLE 2

| Sample No. | Release agent of Surface Layer | Primer Composition of Primer Layer | Belt Layer Peeling |
|---|---|---|---|
| 201 | KS-830E | none | B |
| 202 | KS-830E | Primer PC-7A | A |
| 203 | KS-882 | none | C |
| 204 | KS-882 | Primer PC-7A | B |

As can clearly be seen from Table 2, fixing belts, which were prepared by providing the primer layer on a base material and further providing the releasing layer comprising the silicone resin on said primer layer, minimized belt layer peeling.

Example 3

<<Production of Fixing Belt>>

(Production of Fixing Belt 302)

Fixing Belt 302 was produced in the same manner as Fixing Belt 108 of Example 1, except that the surface layer was prepared employing spray coating instead of dip coating.

(Production of Fixing Belts 301, 303, and 304)

Each of Fixing Belts 301, 303, and 304 was prepared in the same manner as Fixing Belt 302, except that the hardening system or the coating system was varied.

(Preparation of Image Samples 301 through 304 and Glossiness Evaluation Thereof)

Each of Fixing Belts 301 through 304, prepared as above, was installed in an ink jet printer fitted with the thermal fixing apparatus described in FIG. 1. In the same manner as Example 1, a solid black image was printed and was thermally fixed employing the fixing apparatus in said printer, whereby Image Samples 301 through 304 was prepared. Herein, temperature of the heating roller, which transmitted heat onto the fixing belt, was adjusted to 120° C. Glossiness of Image Samples 301 through 304 was evaluated in the same manner as described in Example 1. Table 3 shows the results.

TABLE 3

| Sample No. | Release agent of Surface Layer | Coating System | Hardening System | Glossiness |
|---|---|---|---|---|
| 301 | KS-830E | dip coating | addition type | 88 |
| 302 | KS-830E | spray coating | addition type | 50 |
| 303 | KS-882 | dip coating | condensation type | 68 |
| 304 | KS-5508 | dip coating | UV type | 65 |

As can clearly be seen from Table 3, Sample 301, in which the surface layer had been prepared employing the dip coting, exhibited much higher glossiness than Sample 302 in which the surface layer had been prepared employing the spray coating, and Sample 303, which had been prepared employing the solvent condensation type release agent, exhibited much higher glossiness than Sample 304 which had been prepared employing the UV hardenable release agent.

Example 4

<<Production of Fixing Belts>>

(Production of Fixing Belts 401 through 410)

Each of Fixing Belts 401 through 410 was produced in manner as Fixing Belt 108 described in Example 1, except that components employed in each of fixing belts were replaced with those shown in Table 4.

(Preparation of Image Samples 401 through 410 and Glossiness Evaluation Thereof)

Each of Fixing Belts 401 through 410, prepared as above, was installed in an ink jet printer fitted with the thermal fixing apparatus described in FIG. 1. In the same manner as Example 1, a solid black image was printed and was thermally fixed employing a fixing apparatus in said printer, whereby Samples 401 through 410 was prepared. Herein, temperature of the heating roller, which transmitted heat onto the fixing belt, was adjusted to 120° C. Glossiness of Image Samples 401 through 410 was evaluated in the same manner as described in Example 1. Table 4 shows the results.

TABLE 4

| | Base Material | | | | |
|---|---|---|---|---|---|
| Sample No. | Material | Young's Modulus (in kN/mm$^2$) | Surface Roughness in $\mu$m | Thickness in $\mu$m | Glossiness |
| 401 | nickel | 199.5 | 0.05 | 20 | 87 |
| 402 | nickel | 199.5 | 0.1 | 20 | 75 |
| 403 | nickel | 199.5 | 0.2 | 20 | 65 |
| 404 | nickel | 199.5 | 0.05 | 5 | 68 |
| 405 | nickel | 199.5 | 0.05 | 100 | 78 |
| 406 | nickel | 199.5 | 0.05 | 150 | 61 |
| 407 | aluminum | 70.3 | 0.05 | 20 | 77 |
| 408 | iron | 211.4 | 0.05 | 20 | 77 |
| 409 | polyethylene | 0.4 to 1.3 | 0.05 | 20 | 62 |
| 410 | elastic rubber | 1.5 to $5.0 \times 10^{-13}$ | 0.05 | 20 | 56 |

As can clearly be seen from Table 4, Samples 401 through 406, which had been prepared employing the fixing belt using nickel as a base material, exhibited excellent glossiness.

Example 5

<<Production of Fixing Roller>>

(Production of Fixing Roller 501)

One L of a release agent (trade name: KS-830E, manufactured by Shin-Etsu Kagaku Kogyo Co.) for release paper sheets was mixed with 10 ml of a catalyst (trade name: CAT-PL-50T, also manufactured by Shin-Etsu Kagaku Kogyo Co.), and the volume of the resultant mixture was adjusted to 5 L by adding toluene. The resultant mixture was placed in a cylindrical beaker of an interior diameter of 15 cm and a height of 50 cm. A $\phi$50 mm×width 394 mm hollow aluminum roller of an interior diameter of 24 mm was installed in a dip type coater, and said roller was lowered and dipped into said composition said beaker. Subsequently, while pulling up said roller at a rate of 10 mm/second, a surface layer was applied onto said roller. After setting the coating aside at room temperature for 5 minutes, the resulting coating was subjected to thermal hardening at 120° C. for one hour in an oven, whereby a surface layer was prepared. The resultant thickness of said surface layer was from 2 to 4 $\mu$m. Further, a commercially available halogen lamp was installed in the hollow section, whereby a heating roller was prepared. Fixing rollers 501 was produced by combining said heating roller with a pressure roller.

(Preparation of Image Sample 501)

Fixing Roller 501, prepared as above, was installed in an ink jet printer fitted with the thermal fixing apparatus described in FIG. 2. Employing ink for ink jet printing, a solid black image was printed onto Ink Jet Recording Material 1 described in Example 1, and thereafter, was thermally fixed employing a fixing apparatus in said printer, whereby Image Samples 501 was prepared. Herein, temperature of the heating roller which constituted fixing rollers was set at 120° C.

(Preparation of Image Sample 502)

Image Sample 502 was prepared in the same manner as Image Sample 501, except that Ink Jet Recording Material 1 was replaced with Konica Photo-Like QP Paper.

(Preparation of Image Sample 503)

Image Sample 503 was prepared in the same manner as Image Sample 502, except that the ink for ink jet printing was replaced with the dye ink described below.

(Preparation of Dye Inks: Yellow, Magenta, Cyan, and Black)

Each of ink compositions was prepared employing the formulas described below. After well stirring, the resultant composition was filtered employing a 0.8 μm filter (DISMIC-25CS, manufactured by Toyo Roshi Kaisha Ltd.), and then employed.

| | |
|---|---|
| (Preparation of Yellow Ink) | |
| Acid Yellow 42 (acid dye) | 5 weight percent |
| Proxel GXL (D) (a 20 percent aqueous solution, manufactured by Zeneca Corp.) | 0.2 weight percent |
| Ethylene glycol | 12 weight percent |
| Diethylene glycol | 13 weight percent |
| Deionized water to make | 100 weight percent |
| (Preparation of Magenta Ink) | |
| Acid Red 249 (acid dye) | 3 weight percent |
| Proxel GXL (D) (a 20 percent aqueous solution, manufactured by Zeneca Corp.) | 0.2 weight percent |
| Ethylene glycol | 12 weight percent |
| Diethylene glycol | 13 weight percent |
| Deionized water to make | 100 weight percent |
| (Preparation of Cyan Ink) | |
| Acid Blue 249 (acid dye) | 3.8 weight percent |
| Proxel GXL (D) (a 20 percent aqueous solution, manufactured by Zeneca Corp.) | 0.2 weight percent |
| Ethylene glycol | 12 weight percent |
| Diethylene glycol | 13 weight percent |
| Deionized water to make | 100 weight percent |
| (Preparation of Black Ink) | |
| BASF Acid Black 34 (acid dye) | 19 weight percent |
| Proxel GXL (D) (a 20 percent aqueous solution, manufactured by Zeneca Corp.) | 0.2 weight percent |
| Ethylene glycol | 12 weight percent |
| Diethylene glycol | 13 weight percent |
| Deionized water to make | 100 weight percent |

(Preparation of Image Sample 504)

The heating roller fixing device of a digital copier Konica 7075 (manufactured by Konica Corp.) was modified to a fixing apparatus described in FIG. 2 so as to make it possible to optionally set the heating roller temperature. Thereafter, the black toner attached to Konica 7075 was placed in said copier, and the temperature of the heating roller was adjusted to 120° C. Subsequently, solid black images were printed and fixed. The resultant print was designated as Image Sample 504. Incidentally, fixed image samples were prepared employing A4 plain paper sheets (having a basis weight of 65 g/m$^2$).

Glossiness of each of obtained Image Samples 501 through 504 was evaluated in the same manner as Example 1. Table 5 shows the results.

TABLE 5

| Sample No. | Recording System | Medium | Colorant | Glossiness before Fixing | Glossiness after Fixing |
|---|---|---|---|---|---|
| 501 | ink jet | Recording Paper 1 | pigment ink | 42 | 86 |
| 502 | ink jet | Konica Photo-Like QP Paper | pigment ink | 40 | 51 |
| 503 | ink jet | Konica Photo-Like QP Paper | dye ink | 51 | 63 |
| 504 | Electrophotography | plain paper sheet | toner | 18 | 45 |

Table 5 shows that the image, which was fixed employing the fixing roller of the present invention, exhibited higher glossiness than that prior to fixing.

Example 6

<Production of Fixing Rollers 602 and 603>

Fixing Roller 602 was prepared in the same manner as Fixing Roller 501, except that coating was carried out employing a circular slide hopper, while Fixing Roller 603 was prepared in the same manner as Fixing Roller 501, except that spray coating was employed.

<Preparation of Image Samples 602 and 603>

Each of Image Samples 602 and 603 was prepared in the same manner as Image Sample 501, except that each of Fixing Rollers 602 and 603 was employed. Glossiness of each of the resultant Image Samples 602 and 603 was evaluated in the same manner as Example 1. Table 6 shows the results.

TABLE 6

| Sample No. | Coating System | Glossiness |
|---|---|---|
| 501 | dip coating | 86 |
| 602 | circular slide hopper coating | 83 |
| 603 | spray coating | 51 |

As can clearly be seen from Table 6, samples, prepared employing the fixing roller which had been prepared employing the dip coating or the circular slide hopper coating, exhibited higher glossiness than that of the sample prepared employing the fixing roller which had been prepared employing the spray coating.

Effects of the Invention

The present invention is capable of providing a fixing belt and a fixing roller which result in excellent gloss of images after fixing, and result in neither layer peeling of the fixing member during thermal fixing, nor offsetting, a production method of the same, a thermal fixing apparatus, and an image forming method.

What is claimed is:

1. A fixing belt for fixing an ink jet image recorded on an ink jet recording material by heat, the fixing belt comprising:

a base material having thereon a surface layer which contacts the ink jet image on the ink jet recording material during fixing, wherein the surface layer has a peel strength thereon of not less than 200 g/5 cm, and the surface layer is produced by a method comprising the steps of:

coating a hardenable silicone on the base material by a dip coating; and hardening the coated hardenable silicone by heat.

2. The fixing belt of claim 1, wherein the fixing belt further comprises a primer layer between the surface layer and the base material.

3. The fixing belt of claim 1, wherein the base material is a seamless nickel belt.

4. The fixing belt of claim 1, wherein the surface contact angle of the surface layer is from 100 to 120 degrees.

5. The fixing belt of claim 1, wherein the surface roughness of the surface layer is not more than 0.2 $\mu$m.

6. The fixing belt of claim 5, wherein the surface roughness of the surface layer is not more than 0.1 $\mu$m.

7. The fixing belt of claim 1, wherein the thickness of the surface layer is from 1 to 50 $\mu$m.

8. The fixing belt of claim 1, wherein the thickness of the base material is from 10 to 100 $\mu$m.

9. The fixing belt of claim 1, wherein the Young's modulus of the base material is not less than 50 kN/mm$^2$.

10. The fixing belt of claim 1, wherein the hardenable silicone is an addition hardenable silicone or a condensation hardenable silicone.

11. An image fixing method for fixing an ink jet image recorded on an ink jet recording material with utilizing a heating means, a pressure means and the fixing belt described in claim 1, the method comprising:

letting the ink jet recording material and the fixing belt in a facing state through between the heating means and the pressure means.

12. The image fixing method of claim 11, wherein the ink jet image is an ink jet pigment image.

13. The image fixing method of claim 11, wherein the ink jet recording material comprises a surface layer and an ink absorbing layer adhering the surface layer, the surface layer containing a thermoplastic resin, the ink absorbing layer containing inorganic particles.

14. A fixing belt for fixing an ink jet image recorded on an ink jet recording material by heat, the fixing belt comprising:

a base material having thereon a surface layer which contacts the ink jet image on the ink jet recording material during fixing, wherein the surface layer has a pencil hardness of HB or more, and the surface layer is produced by a method comprising the steps of:

coating a hardenable silicone on the base material by a dip coating; and hardening the coated hardenable silicone by heat.

15. The fixing belt of claim 14, wherein the fixing belt further comprises a primer layer between the surface layer and the base material.

16. The fixing belt of claim 14, wherein the base material is a seamless nickel belt.

17. The fixing belt of claim 14, wherein the surface contact angle of the surface layer is from 100 to 120 degrees.

18. The fixing belt of claim 14, wherein the surface roughness of the surface layer is not more than 0.2 $\mu$m.

19. The fixing belt of claim 18, wherein the surface roughness of the surface layer is not more than 0.1 $\mu$m.

20. The fixing belt of claim 14, wherein the thickness of the surface layer is from 1 to 50 $\mu$m.

21. The fixing belt of claim 14, wherein the thickness of the base material is from 10 to 100 $\mu$m.

22. The fixing belt of claim wherein the Young's modulus of the base material is not less than 50 kN/mm$^2$.

23. The fixing belt of claim 14, wherein the hardenable silicone is an addition hardenable silicone or a condensation hardenable silicone.

24. An image fixing method for fixing an ink jet image recording on an ink jet recording material with utilizing a heating means, a pressure means and the fixing belt described in claim 14, the method comprising:

letting the ink jet recording material and the fixing belt in a facing state through between the heating means and the pressure means.

25. The image fixing method of claim 24, wherein the ink jet image is an in ink jet pigment image.

26. The image fixing method of claim 24, wherein the ink jet recording material comprises a surface layer and an ink absorbing layer adhering the surface layer, the surface layer containing a thermoplastic resin, the ink absorbing layer containing inorganic particles.

27. A producing method of a fixing belt for fixing an ink jet image recorded on an ink jet recording material, the method comprising the steps of:

coating a hardenable silicone on a base material by dip coating; and making a surface layer by fixing the coated hardenable silicone by heat, wherein the surface layer has a peel strength thereon of not less than 200 g/5 cm.

28. A producing method of a fixing belt for fixing an ink jet image recorded on an ink jet recording material, the method comprising the steps of:

coating a hardenable silicone onto a side of a base material that contacts the ink jet image by e dip coating; and making a surface layer by fixing the coated hardenable silicone by heat, wherein the surface layer has a pencil hardness of HB or more.

29. A fixing belt for fixing an image formed on a recording material by an ink, the fixing belt comprising:

a base provided on a side which is not contacting with the recording material; and a surface layer which contacts the image on the recording material during fixing, the surface layer being formed by hardening a hardenable silicone that is dipped on the base by heat, and having a peel strength thereon of not less than 200 g/5 cm.

30. A fixing belt for fixing an image formed on a recording material by an ink, the fixing belt comprising:

a base provided on a side which does not contact the recording material; and a primer layer formed on the base; and a surface layer which contacts the image on the recording material during fixing and is formed on the primer layer, the surface layer being formed by hardening a hardenable silicone that is dipped on the base by heat, and having a peel strength thereon of not less than 200 g/5 cm.

31. An image forming method comprising the steps of:

printing an image on a recording material having a resin on a surface thereof by an ink; and fixing the image printed on the recording material by pressurizing and heating through a belt, wherein the belt has a base provided on a side which does not contact the recording material and a surface layer which contacts the image on the recording material, the surface layer being formed by hardening a hardenable silicone that is dipped on the base by heat, and having a peel strength thereon of not less than 200 g/5 cm.

32. A fixing belt for fixing an ink jet image recorded on an ink jet recording material by heat, the fixing belt comprising a base material having thereon a surface layer contacting the ink jet image on the ink jet recording material during fixing, wherein the surface layer has a peel strength thereon of not less than 200 g/5 cm and a pencil hardness of HB or more, and the surface layer is produced by a method comprising the steps of:

coating a hardenable silicone on the base material by dip coating; and hardening the coated hardenable silicone by heat.

* * * * *